US005519472A

United States Patent [19]

Ojima et al.

[11] Patent Number: 5,519,472

[45] Date of Patent: May 21, 1996

[54] DEVELOPING APPARATUS USING ELASTIC BLADE

[75] Inventors: Masaki Ojima, Inagi; Masaharu Ohkubo, Yokohama; Hiroki Kisu, Fujisawa; Kazushige Sakurai, Tokyo; Michihito Yamazaki, Tokyo; Yukihiro Ohzeki, Tokyo; Junichi Kato, Sagamihara; Hiroto Hasegawa, Kawasaki; Erika Asano, Tokyo; Hiroshi Sato, Tokyo; Katsuhiro Sakaizawa, Tokyo; Hiroaki Ogata, Kawasaki, all of Japan

[73] Assignee: Canon Kabushiki Kaisha, Tokyo, Japan

[21] Appl. No.: 220,553

[22] Filed: Mar. 31, 1994

[30] Foreign Application Priority Data

| | | | |
|---|---|---|---|
| Mar. 31, 1993 | [JP] | Japan | 5-096911 |
| Mar. 31, 1993 | [JP] | Japan | 5-096913 |
| Mar. 31, 1993 | [JP] | Japan | 5-096918 |

[51] Int. Cl.[6] ..... G03G 21/00

[52] U.S. Cl. ..... 355/246; 118/657; 355/265

[58] Field of Search ..... 355/253, 245, 355/246, 250, 251, 259, 265, 268; 118/653, 657, 658

[56] References Cited

U.S. PATENT DOCUMENTS

| | | | |
|---|---|---|---|
| 4,444,864 | 4/1984 | Takahashi | 118/653 X |
| 4,935,784 | 6/1990 | Shigehiro et al. | 355/253 |
| 4,989,044 | 1/1991 | Nishimura et al. | 355/251 |
| 4,990,959 | 2/1991 | Yamamuro et al. | 355/245 |
| 5,001,517 | 3/1991 | Hosaka et al. | 355/251 X |
| 5,084,733 | 1/1992 | Katoh et al. | 355/251 |
| 5,177,537 | 1/1993 | Okano et al. | 355/259 |
| 5,202,729 | 4/1993 | Miyamoto et al. | 355/251 |
| 5,235,386 | 8/1993 | Yano et al. | 355/219 |
| 5,286,917 | 2/1994 | Unno et al. | 118/651 |

FOREIGN PATENT DOCUMENTS

| | | |
|---|---|---|
| 3517625 | 11/1985 | Germany . |
| 57-94767 | 6/1982 | Japan . |
| 5019145 | 1/1993 | Japan . |

*Primary Examiner*—A. T. Grimley
*Assistant Examiner*—Shuk Y. Lee
*Attorney, Agent, or Firm*—Fitzpatrick, Cella, Harper & Scinto

[57] ABSTRACT

A developing apparatus includes a developer carrying member for carrying developer, an elastic blade press-contacted to the developer carrying member to regulate a layer of developer formed on the developer carrying member, where the elastic blade comprises an electrically conductive layer, and a high resistance layer located at the developer carrying member side of the conductive layer, and an electric field generating device for forming an oscillating electric field between the developer carrying member and the conductive layer, wherein a maximum intensity of the electric field is not less than $10^6$ V/m.

17 Claims, 17 Drawing Sheets

DEVELOPING APPARATUS USING ELASTIC BLADE

FIELD OF THE INVENTION AND RELATED ART

The present invention relates to a developing apparatus usable with a copying machine, printer or the like of an electrophotographic type or an electrostatic recording type.

Referring to FIG. 1, there is shown an example of an image forming apparatus of an electrophotographic type. The electrophotographic recording apparatus 1 (printer engine) is provided with a cylindrical photosensitive drum 2 as a latent image bearing member. The photosensitive drum 2 rotates in one direction about its rotational axis, during which the surface thereof is uniformly charged by a charging device 3. Thereafter, a latent image is formed thereon by an image exposure device 4. A developing device 5 comprises a hopper 7 for accommodating a developer 6 and a developing sleeve 8 (developer carrying member). It supplies the developer 6 to a latent image formed on the photosensitive drum 2 to visualize it. Adjacent the developing sleeve 8, a developing blade 9 as a developer regulating member is disposed. Between the photosensitive drum 2 and the developing sleeve 8, a bias supplying voltage source 19 is connected to supply an AC biased DC voltage to supply a proper developing bias voltage.

An image on the photosensitive drum visualized by the developer 6 is transferred onto a transfer material 11 by a transfer device 10. The transfer material 11 is fed by a sheet feeding roller 12, and is supplied to the transfer device 10 in synchronism with the image on the photosensitive drum by the registration roller 13. The visualized image of the developer transferred onto the transfer material 11 by the transfer drum 10 is conveyed to a fixing device 14 with the transfer material 11, and is fixed on the transfer material 11 by heat or pressure into an image record. The residual developer 6 remaining on the photosensitive drum without being transferred onto the transfer material, is removed by a cleaning device 15. The surface of the photosensitive drum now free of the developer 6 is charged again by the charging device 3, and the above-described steps are repeated.

In the above-described electrophotographic recording apparatus, in order to facilitate maintenance operation, a developing apparatus 5 is made in the form of a developing process unit, and the photosensitive drum 2, the cleaning device 15 and the charging device 3 are made in the form of a cleaning unit 16, in which the respective units are detachably mountable. In a widely used apparatus, the two units are unified into a process cartridge 17, by which the maintenance operation is easy. The developer used in the process unit or the process cartridge is magnetic one component developer in most cases, since then no carrier remains. In the case of using the magnetic one component developer, a magnet 18 is disposed in the developing sleeve in order to retain the developer on the developing sleeve 8. Recently, in order to improve the resolution of the electrophotographic image, the particle size of the toner is reduced to approx. 6–9 μm. In the case of the small particle size toner, the number of particles per unit volume is large as compared with the large particle size toner, and therefore, it is difficult to provide each of the toner particles with the opportunity of contact with the surface of the developing sleeve or the surface of the developing blade with the result of the difficulty in uniform charging. Particularly, in the case of the non-contact type developing device, the charge efficiency of the toner in the developing device is low, and the uniformity of the toner charging tends to be non-uniform. Therefore, reduction of the resolution of the image density, toner scattering, or foggy background tends to occur. As for the blade mounting method, a surface of the developing blade is contacted to the developing sleeve. In this contact type, the toner is pressed to and rubbed with the developing sleeve and the developing blade. Therefore, the toner charging power is high as compared with the no-contact type, and for this reason, it is suitable for the small particle size toner. As for the material of the developing blade of the contact type, there are metal spring such as phosphor bronze, elastic the rubber such as urethane or silicone rubber, which is disposed to provide a predetermined contact pressure to the developing sleeve.

In order to further improve the toner charge efficiency, efforts are made to further reduce the thickness of the toner layer on the developing sleeve for the purpose of increasing the opportunity of the contact of the toner with the developing sleeve or the developing blade. The toner layer thickness can be controlled to some extent by the surface roughness of the developing sleeve, the contact pressure of the developing blade, the hardness of the developing blade or the like. However, in the case of the one component magnetic developer, it is frequently controlled by the surface roughness of the developing sleeve. The toner layer thickness decreases with a decrease in the surface roughness of the developing sleeve, and therefore, the toner charging amount increases therewith.

The toner charge efficiency increases with the reduction of the toner layer thickness as described above. However, if this is done, the amount of the toner supply decreases with the result of lower image density, and therefore, there is a lower limit to the thickness of the layer. With the decrease of the thickness of the toner layer, rubbing between the developing sleeve and the developing blade becomes more influential, with the likely result of non-uniformity of the toner application. To cope with this, the peripheral speed ratio between the photosensitive drum and the developing sleeve is increased to increase the toner supply amount, or a low hardness elastic member (not more than 70 degrees, Asker C) is used at a contact portion of the blade with the developing sleeve, thus suppressing the non-uniform application.

On the other hand, if the toner charge amount is increased too much, then the surface of the developing sleeve or the surface of the developing blade are coated with strongly charged toner (high charge toner) constituting a high charge layer, with the result of various problems.

The high charge layer is produced through the following mechanism. The charged toner is subjected to an electrostatic mirror force proportional to the amount of charge and to a distance from the developing sleeve or the developing blade. In addition, the toner deposited on the developing sleeve surface or the developing blade surface receives various other physical attraction forces. Therefore, if the high charge toner is once deposited on the developing sleeve or the developing blade, then various physical attraction forces are applied, including the electrostatic mirror force as a major component, with the result that it is not easily removed.

The high charge layer prevents contact between the newly supplied toner from coming into contact with the developing sleeve or the developing blade. Thus, the triboelectric charge between toner particles necessarily increases, and therefore, the amount of the oppositely charge toner (reverse toner) is relatively increased with the result of a reduction of the image density or an increase in the fog in the background portion. The high charge layer reduces the charge efficiency, which causes non-uniform toner charging. As a result, if only a part of the toner on the developing sleeve is consumed for the development, then the amount of charge of the toner becomes non-uniform between the consumed portion and not-consumed portion. This influences the next image formation (ghost) in some cases. Particularly under the low humidity condition, the high charge layer covering the developing sleeve is further strongly charged with the result of non-uniform charging, non-uniform application of the toner or another improper image formation (blotch) in some cases. As described, the influence by the existence of the high charge layer on the developing sleeve is significant. Particularly in the case of small size toner particles, they are more closely deposited on the developing sleeve surface of the developing blade surface, and therefore, the problems are more significant.

Japanese Patent Application Publication No. 41068/1988 proposes that an alternating voltage is applied between the developing sleeve and a magnetic blade of iron to accomplish uniform toner application on the sleeve. However, the toner is not triboelectrically charged by the friction between the blade and the toner in this publication. Japanese Patent Application Publication NO. 19145/1993 discloses that an alternating voltage is applied to a metal blade to cause fine vibration of the blade. However, this involves a problem of electrical leakage between the developing roller and the metal blade.

SUMMARY OF THE INVENTION

Accordingly, it is a principal object of the present invention to provide a developing apparatus in which a high charge toner layer is not formed, so that the toner charging efficiency can be improved.

It is another object of the present invention to provide a developing apparatus in which electrical leakage between a developer carrying member and an elastic blade is prevented.

According to an aspect of the present invention, there is provided a developing apparatus comprising: a developer carrying member for carrying a developer; an elastic blade pressed to the developer carrying member to regulate a layer of the developer formed on the developer carrying member, the blade comprising an electrically conductive layer and a high resistance layer at the developer carrying member side of the conductive layer; electric field generating means for forming an oscillating electric field between the image bearing member and the conductive layer; wherein a maximum intensity of the electric field provided by the electric field generating means is not less than $10^6$ V/m.

These and other objects, features and advantages of the present invention will become more apparant upon a consideration of the following description of the preferred embodiments of the present invention taken in conjunction with the accompanying drawings.

DESCRIPTION OF THE PREFERRED EMBODIMENTS

Figure 1:
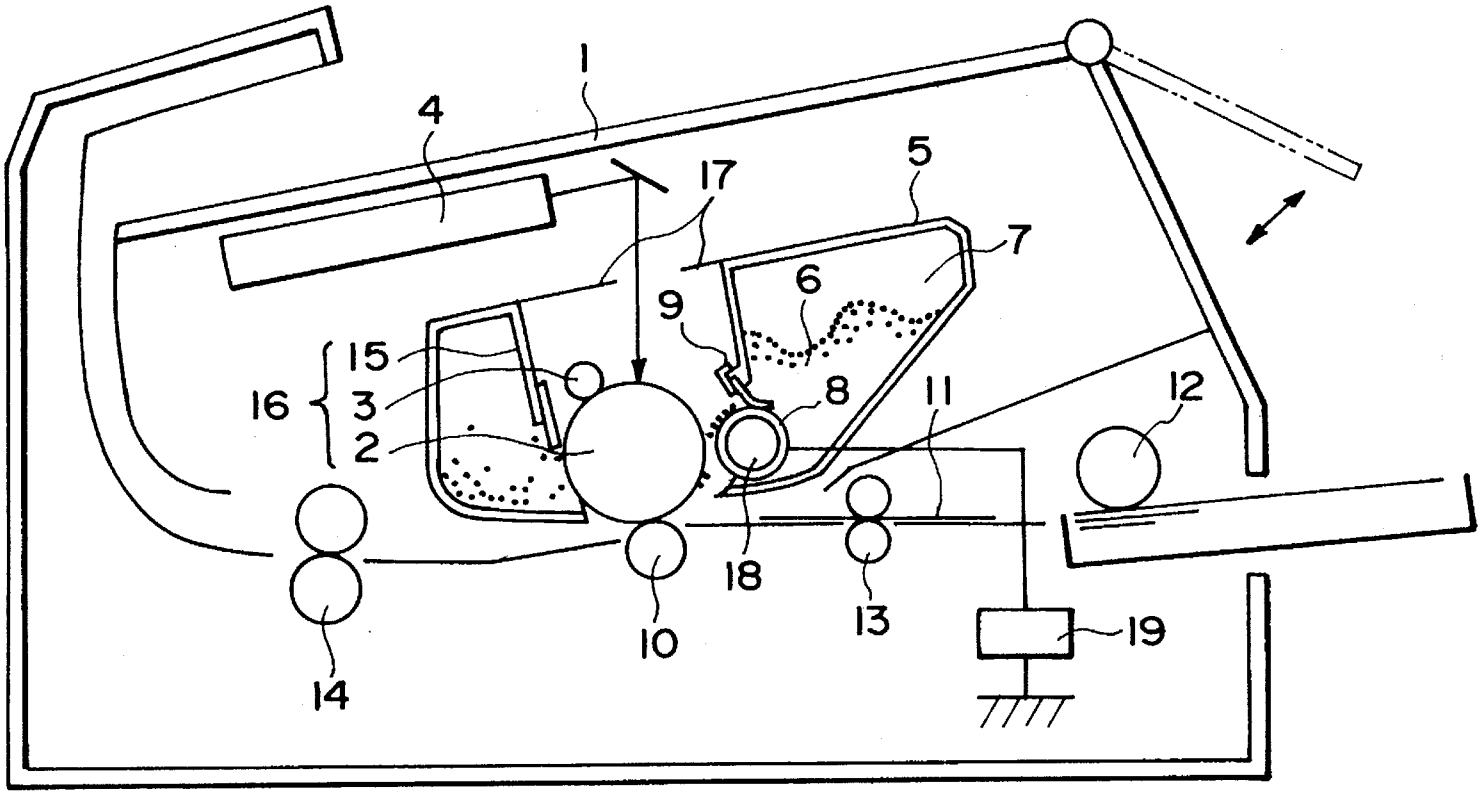
FIG. 1 is a sectional view of an electrophotographic apparatus.
Figure 2:
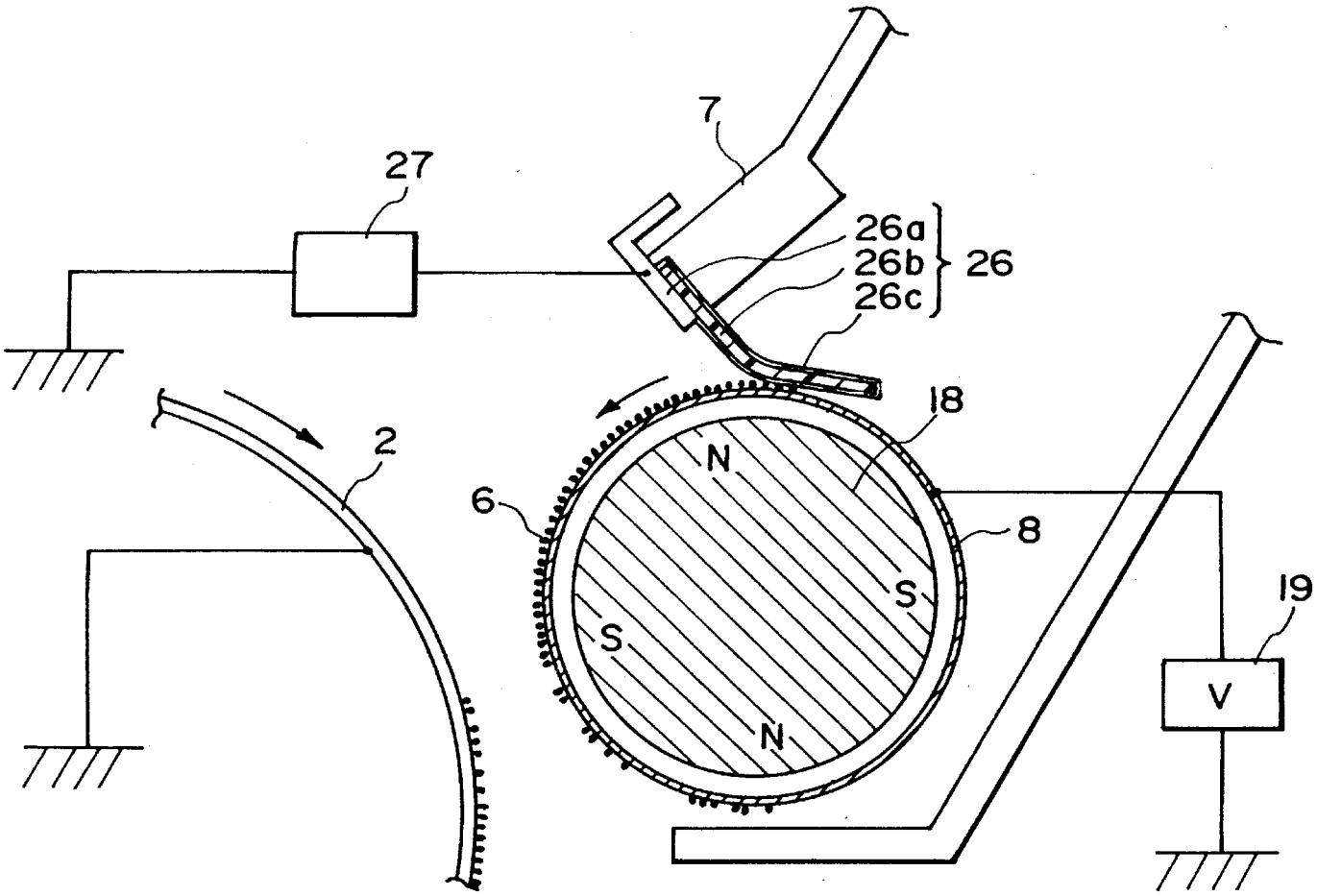
FIG. 2 is a sectional view of a developing apparatus according to an embodiment of the present invention.

Referring to FIG. 2, there is shown a developing apparatus according to an embodiment of the present invention. A developer regulating member in the form of a developing blade 26 comprises a supporting metal plate 26*a* fixed to a hopper 7, an electrically conductive rubber member 26*b* (carbon-dispersed EPDM) bonded to the supporting metal plate at the end thereof, a high resistance layer 26*c* of urethane resin material having a thickness of approx. 50 μm covering the surface of the electrically conductive rubber member 26*b*. A free end of the conductive rubber member 26*b* is counterdirectionally contacted to the developing sleeve 8. To the conductive rubber 26*b*, a bias voltage source 27 is connected through the supporting metal plate 26*a*, so that a predetermined bias voltage is applied thereto. The high resistance layer 26*c* is provided to prevent leakage between the developing blade 26 and the developing sleeve 8. The rubbing portion between the developing sleeve 8 and the developing blade 26 is approx. 2 mm, the contact pressure is approx. 30 g/cm, and the peripheral speed of the developing sleeve 8 is approx. 94 mm/sec.

The developing sleeve 8 is connected with a developing bias voltage source 19 to apply a predetermined developing bias voltage between the developing sleeve 8 and the photosensitive drum 2. Therefore, the electric field generating means in this embodiment comprises a developing blade 26, a developing sleeve 8, a blade bias voltage source 27 and a developing bias voltage source 19.

In this embodiment, the toner used is a toner having a particle size of approx. 6 μm and is chargeable to the negative polarity. The applied developing bias voltage is as follows:

DC voltage $Vdc$=−400 V

Alternating voltage:

Rectangular wave

Amplitude Vac=1.7 kVpp

Frequency f=1800 Hz

The blade bias voltage applied to the blade was Vdc=0 V, and no AC voltage was applied. In other words, the developing blade was electrically grounded.

In the case of powder toner, the charge amount of the individual toner particles is mostly not more than $10^{-3}$c, and the electrostatic mirror force of the individual toner particles is mostly not more than $10^{-7}$N.

Therefore, the maximum magnetic intensity of the AC electric field is not less than $10^6$ V/m.

If it is not less than $10^6$ V/m, then the high charge toner layer can be removed from the developing sleeve by only the force provided by the electric field. However, if the physical attraction forces due to the surface tension water deposited on the toner, the magnetic confining force or then the like is strong, the maximum intensity is preferably not less than $10^7$ ohm/cm.

If it increases to $10^8$ V/m, then the electric leakage may occur, and therefore, $10^8$ V/m or lower is preferable.

In this embodiment, as described in the foregoing, the regulating bias voltage is applied between the sleeve and the blade, so that attraction force to the developing blade is produced by the electric potential difference between the developing sleeve and the developing blade, by which the developing blade is vibrated. Therefore, the force provided by the above-described electric field and the vibration of the developing blade are applied to the toner. This is one of the features of this embodiment.

The voltage applied between the developing sleeve and the developing blade as described above, is −1200 V and +400 V, with the reference of the developing blade. The urethane resin high resistance layer has a thickness of approx. 50 μm, and the specific dielectric constant thereof is approx. 3. The thickness of the toner layer is approx. 100 μm, and the dielectric constant thereof is approx. 1. If these are reasonably assumed, then the maximum electric field is $1\times10^7$ V/m in the direction of removing the toner from the developing sleeve in the high charge toner layer. The range of contact pressure variation is approx. 1.5 g/cm. It has been confirmed that in this embodiment the high charge toner layer can be removed from the developing sleeve if the range of variation of the contact pressure is approx. 10% of the contact pressure. In this embodiment, the contact pressure of the developing blade is approx. 30 g/cm, and therefore, the range of variation of the contact pressure does not satisfy this. However, the high charge layer can be further easily removed as compared with the first embodiment. The reason for this is considered as follows. A synergistic effect is provided by the force in the peripheral direction of the developing sleeve by the vibration of the developing blade and a force of the electric field substantially perpendicular to the surface of the developing sleeve, is provided.

Figure 3:
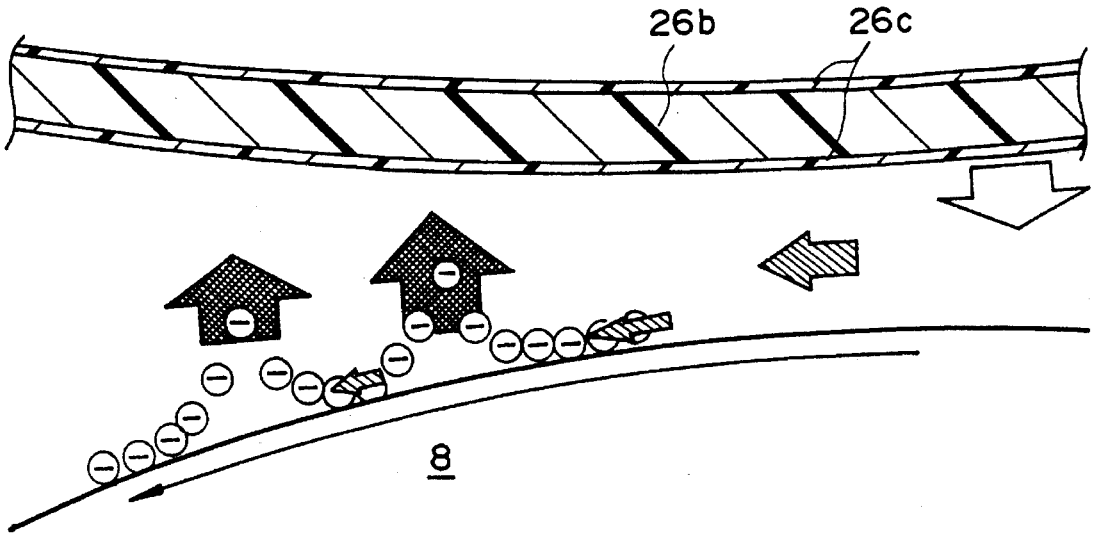
FIG. 3 is a sectional view of a part of the developing apparatus of FIG. 2, illustrating high charge toner layer.

Referring to FIG. 3, the behavior will be further described. By the vibration of the developing blade 26 due to the potential difference between the developing sleeve and the developing blade, the high charge layer is given a peripheral force with respect to the developing sleeve 8 surface (hatched arrow in the Figure), so that the physical attraction force is reduced to make removal from the developing sleeve easier. When the electric field is applied perpendicularly to the developing sleeve 26, the high charge toner layer is easily removed from the developing sleeve by the Coulomb's force. The easy removal of the high charge toner layer is caused by the forces in the different directions. If there is no force due to the variation of the contact pressure or the like, and only the force due to the electric field is applied, then it is difficult to remove the high charge toner layer from the developing sleeve. It is desirable that the direction of the electric field is to remove the toner from the developing sleeve.

Figure 4:
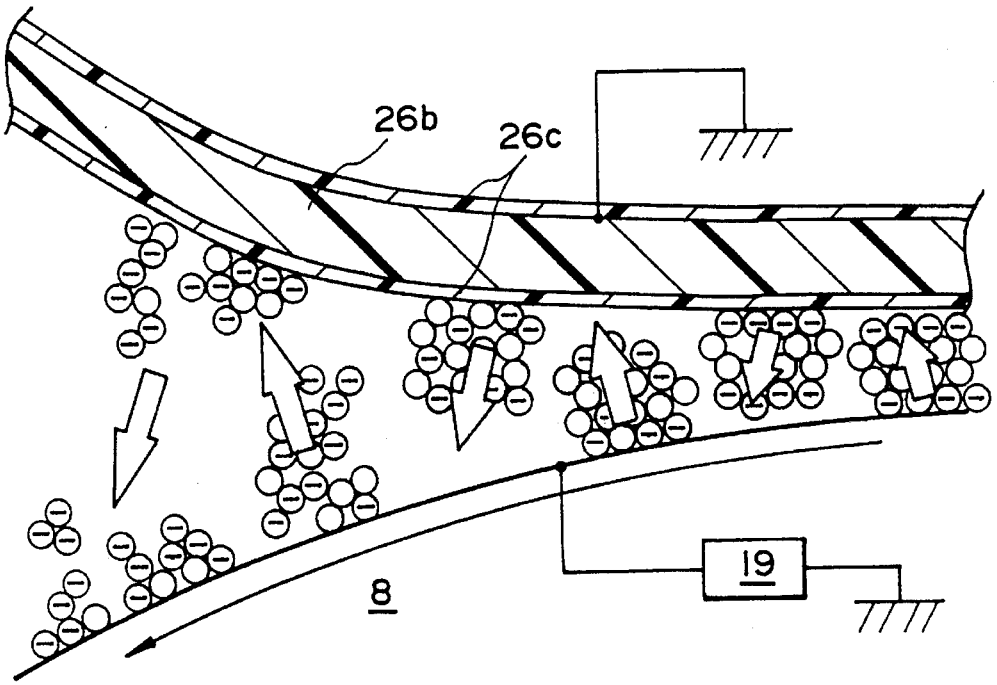
FIG. 4 is a sectional view of a part of the developing apparatus of FIG. 2 in which the behavior of the high charge toner layer at a downstream portion is illustrated with elapse of time.

In this embodiment, the force applied between the developing blade and the developing sleeve alternates, and therefore, the high charge toner layer once removed moves between the developing blade and the developing sleeve, and therefore, they are stirred. In the region downstream of the contact position, as shown in FIG. 4 with elapse of time (from the right to the left), the toner reciprocates so that strong stirring effect can be provided. Thus, the charge non-uniformity can be almost removed. To enhance the stirring effects, it is desirable that an alternating electric field is applied between the developing blade and the developing sleeve. In addition, simultaneously with the removal of the charge non-uniformity, any toner application non-uniformity due to foreign matters between the developing blade and the developing sleeve can be removed to the extent that it is practically no problem.

The experiments of this embodiment will be described. In this experiment, a high charge toner layer of normal black toner is formed on the developing sleeve, and toner other than the toner in the high charge toner layer is removed, and another toner having another color but substantially the same properties is supplied. The degree of the high charge toner removing effect has been investigated with a parameter of an amplitude Vac of the developing bias.

The developing bias voltage was:

DC voltage $Vdc$=−400 V

Alternating voltage:

Rectangular wave

Frequency f=1800 Hz
Blade bias:

DC voltage $Vd$=400 V

As a result, the lower limit of the high charge toner layer removing effect has been Vac=1000 V. The voltage applied between the developing sleeve and the developing blade is ±500 V with the reference of the potential of the developing blade. If the other conditions are the same as the above-described embodiment, the then range of variation of the contact pressure has been measured as approx. 0.38 g/cm. The maximum electric field at the rubbing portion is approx. $4.2\times10^6$ V/m. The lower limit of the high charge toner layer formation prevention has been Vac=500 V. The voltage applied between the developing sleeve and the developing blade is ±250 V with the reference of the potential of the developing blade. If the other conditions are the same as the abovementioned embodiment, the then range of variation of the contact pressure has been approx. 0.095 g/cm, and the maximum electric field in the rubbing portion has been $2.1\times10^6$. When the above-described electric field is applied, the variation of the contact pressure for preventing high charge toner layer formation and the high charge toner layer removal may be quite low, as compared with the case when the electric field is not applied. The proper range of the contact pressure variation is dependent upon the rotational speed of the developing sleeve or the target toner layer thickness or the like. However, if the contact pressure is 10–300 g/cm, then the maximum electric field of not less than $10^6$ V/m is enough to provide the prevention effect of the high charge toner layer formation even if the variation range of the contact pressure is 0.3% of the contact pressure. In order to provide the high charge toner layer removal effects with these conditions, the contact pressure variation range is not less than 1% of the contact pressure.

Figure 5:
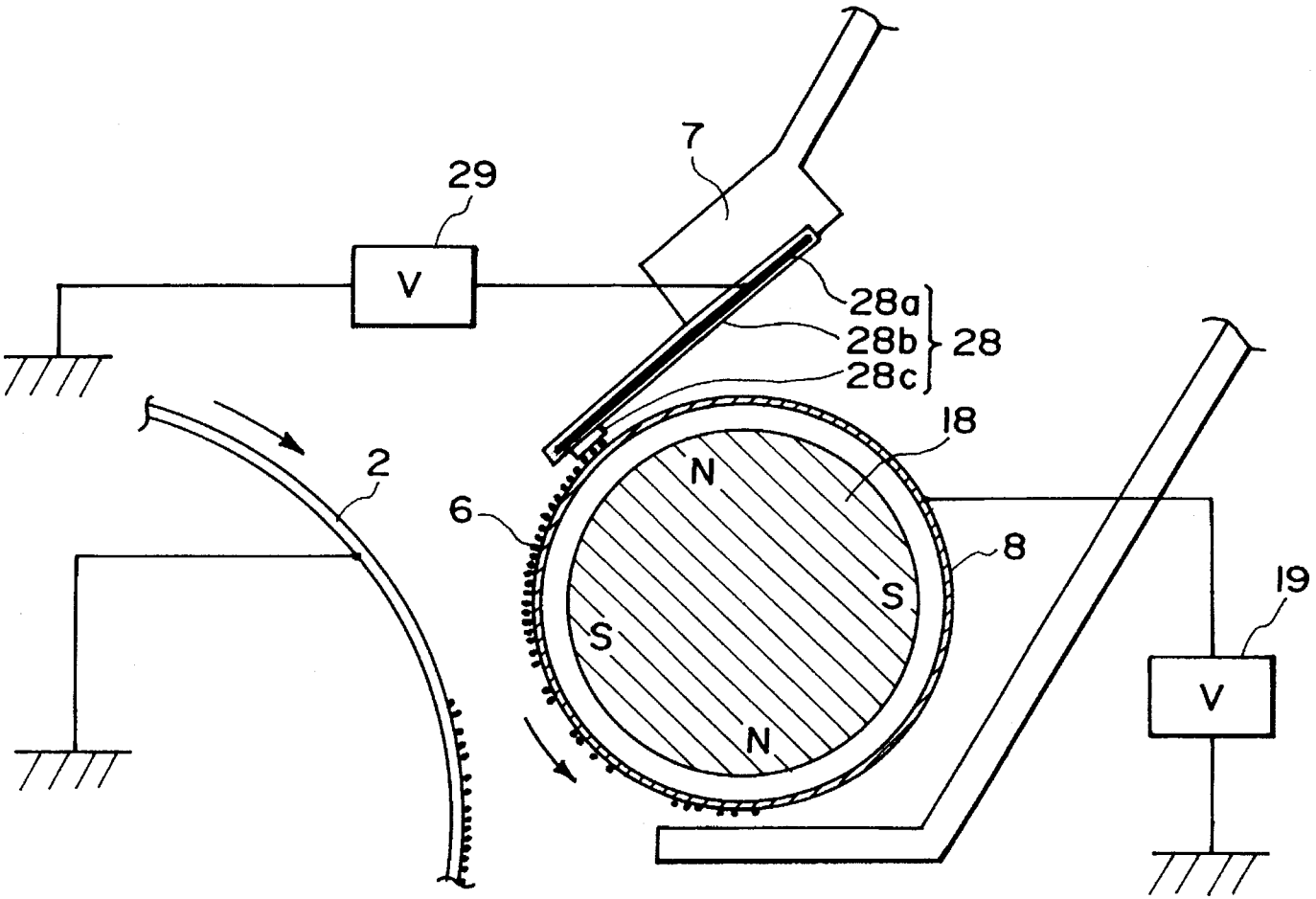
FIG. 5 is a sectional view of a developing apparatus according to another embodiment of the present invention.

Referring to FIG. 5, a second embodiment of the present invention will be described. In this embodiment, the developer regulating member is in the form of a developing blade 28 comprises a non-magnetic SUS metal plate 28*a* having a thickness of 0.1 mm fixed to the hopper 7, a polyamide resin high resistance layer 28*b* having a thickness of approx. 40 μm and covering the surface of the metal plate, and urethane rubber 28*c* having a thickness of approx. 0.4 mm bonded to a portion of the free end of the high resistance layer that is in rubbing contact with the developing sleeve 8. The developing blade 28 is contacted codirectionally with the rotational movement of the developing sleeve. In this embodiment, the rubbing portion between the developing sleeve 8 and the developing blade 28 is approx. 2.5 mm, and the contact pressure per unit longitudinal length is approx. 30 g/cm, and the peripheral speed of the developing sleeve 8 is approx. 94 mm/sec.

The non-magnetic SUS metal plate 28*a* is connected with a blade bias voltage 29 so that a predetermined bias voltage can be applied. The developing sleeve 8 is connected with a developing bias voltage source 19 to apply a predetermined developing bias voltage between the developing sleeve 8 and the photosensitive drum 2. The polyamide resin high resistance layer 28*b* is provided to prevent electrical leakage between the developing blade 28 and the developing sleeve 8.

In this embodiment, a negatively chargeable toner is used as in the foregoing embodiment. The developing bias voltage was:

DC voltage $Vdc$=−400 V

AC voltage:
Rectangular wave
Amplitude Vac=1.6 kVpp
Frequency f32 1800 Hz
The blade bias voltage was:

DC voltage $Vdc$=0 V

AC voltage:
Sine wave
Amplitude Vac=1.0 kVpp
Frequency f=500 Hz

In this embodiment, the urethane rubber has a thickness of approx. 400 μm, the specific dielectric constant is approx. 3. The nylon resin high resistance layer has a thickness of approx. 40 μm and a specific dielectric constant of approx. 4. The toner layer has a thickness of approx. 60 μm and a specific dielectric constant of approx. 1. The voltage is 1700 V at the maximum with the reference of the potential of the developing blade, and therefore, the maximum strength of the electric field is approx. $8.4\times10^6$ V/m, and the contact pressure variation range in the rubbing portion is approx. 1.0 g/cm.

Under these conditions, the electric field applied between the developing blade and the developing sleeve is quite complicated, but it has been confirmed that the high charge toner layer is sufficiently removed.

Similarly to the foregoing embodiment, a developing bias voltage is applied between the sleeve and the blade, and the attraction force is applied to the developing blade due to the potential difference between the developing sleeve and the developing blade with the result of vibration of the developing blade. Therefore, the toner is subjected to the force due to the electric field and the force due to the vibration of the developing blade. With the electric field and the vibration capable of removing the high charge toner layer, the waveform of the electric field may be any type. For example, the blade bias voltage may be in the form of a rectangular wave or saw-tooth wave. The vibration of the developing blade is provided by the potential difference from that of the faced developing sleeve, and therefore, the electric field applied between the developing blade and the developing sleeve may be one way (the direction is not reversed).

Figure 6:
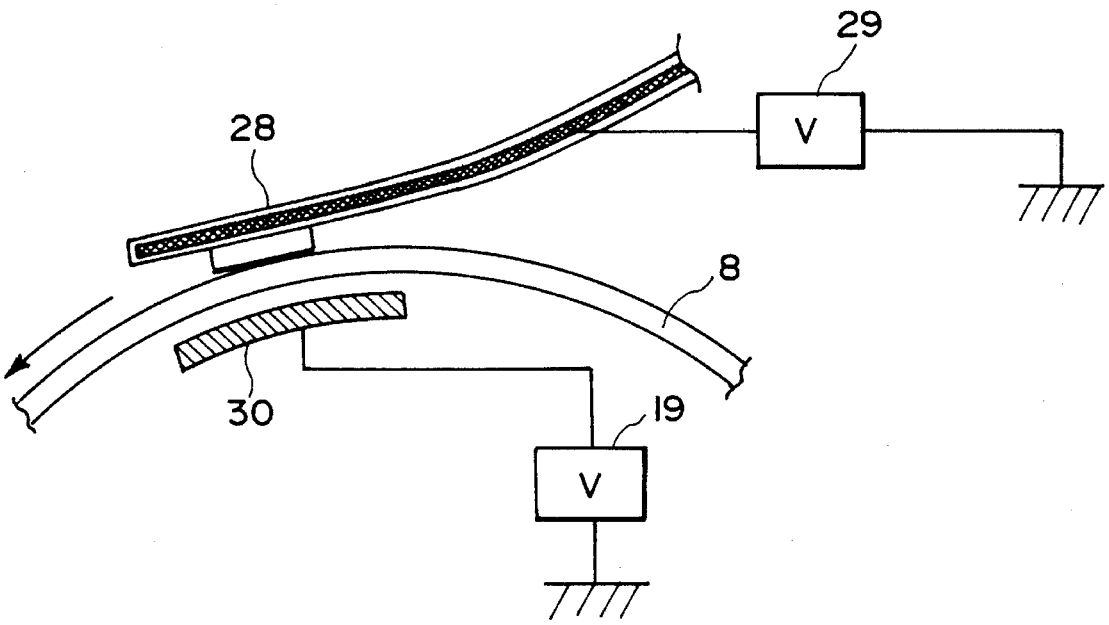
FIG. 6 is a sectional view of a part of a developing apparatus according to a further embodiment of the present invention.

As will be understood from the foregoing description, in this embodiment, at or adjacent the contact portion between the developing sleeve and the developing blade, the fine vibration is imparted to the developing blade to remove the high charge layer, and this is important. In addition, by the application of the electric field, the fine vibration is produced in the developing blade, and the concurrently occurring electric field between the developing sleeve and the developing blade, the high charge layer is easily removed. The configuration, structure, the material or the like of the developing blade or the developing sleeve are not limited as long as the easy removal is accomplished. For example, as shown in FIG. 6, an electrode 30 may be provided inside the developing sleeve 8, and an oscillating voltage is applied between the electrode and the developing blade 28 with the developing sleeve 8 interposed therebetween. In this case, the developing sleeve may be composed of phenol resin, epoxy resin or another non-metal or non-conductive material. As for the developing process, it may be a contact process or non-contact process. Furthermore, the developing bias voltage may be a DC voltage or an AC voltage.

Figure 7:
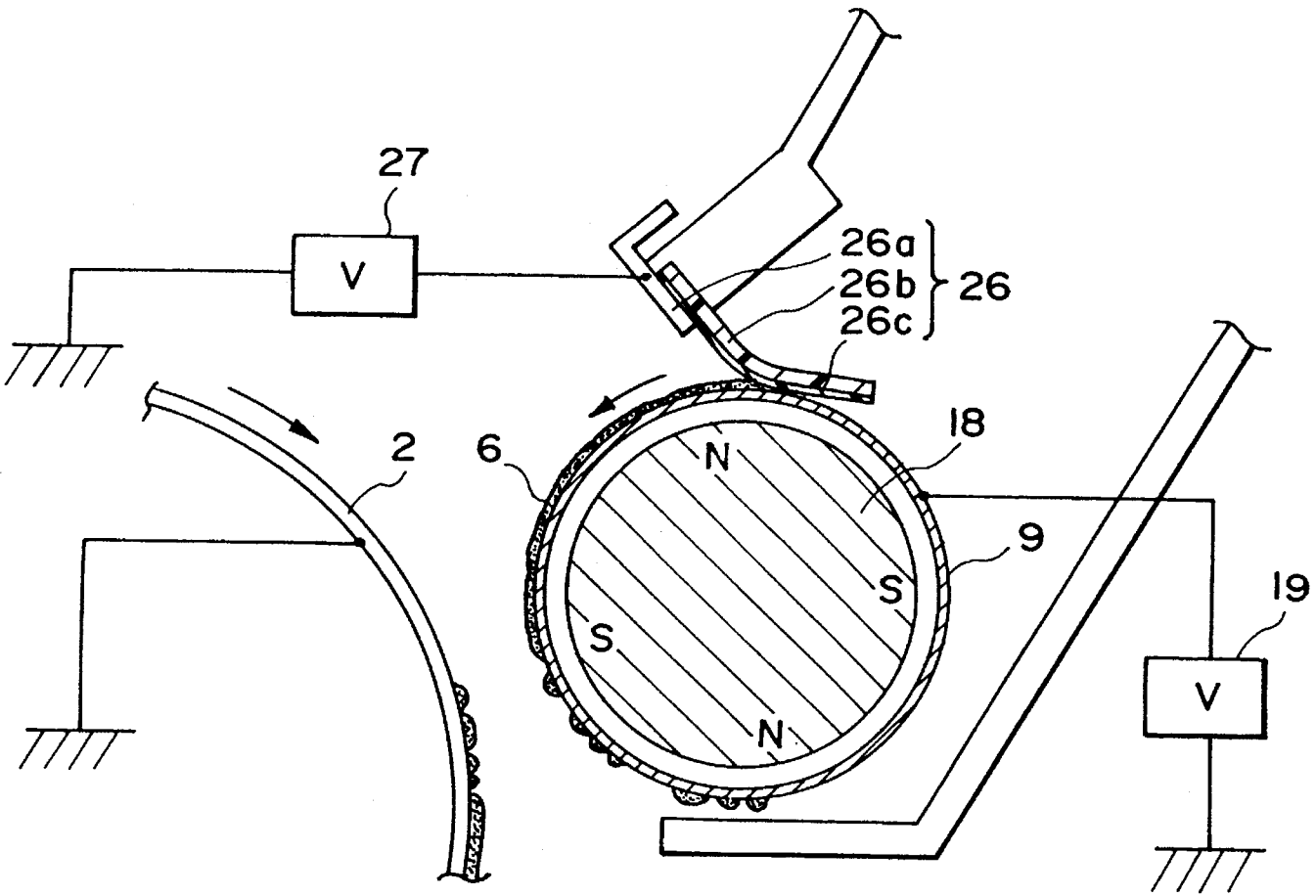
FIG. 7 is a sectional view of a developing apparatus according to a further embodiment of the present invention.

Referring to FIG. 7, another embodiment of the present invention will be described. The developer regulating blade is in the form of an elastic blade 26 and comprises an electrically conductive rubber layer 26b functioning as an electrode, is supported on the supporting metal plate 26a by bonding, and a resin high resistance layer 26c covering such a surface thereof close to the developing sleeve 9. In this embodiment, the conductive rubber layer 26b is composed of carbon-dispersed EPDM. The thickness of the resin high resistance layer 26c applied on the surface thereof has a thickness of approx. 50 μm. The blade 26 is in the form of a resin high resistance layer 26c and is contacted to the developing sleeve 9, and the contact therebetween is counter-directional with respect to the rotational direction of the developing sleeve 9.

In this embodiment, the contact portion between the blade 26 and the developing sleeve 9 has a dimension of approx. 2 mm, and the contact pressure therebetween per unit length is approx. 30 g/cm. The peripheral speed of the developing sleeve 9 is approx. 94 mm/sec.

The conductive rubber layer 26b is supplied with a predetermined bias voltage by way of the supporting metal plate 26a from a voltage source 27 connected to the supporting metal 26a. The resin high resistance layer 26c is provided to prevent electrical leakage between the blade 26 and the developing sleeve 9. The developing sleeve 9 is connected with a voltage source 19 so as to be supplied with a predetermined developing bias voltage between the photosensitive drum 2.

In this embodiment, use is made of a negatively chargeable one component magnetic insulative toner 6 having a particle size of approx. 6 μm.

The developing bias voltage applied to the developing sleeve 9 was:

DC voltage $Vdc$=−400 V

AC voltage:

Rectangular wave

Amplitude Vac=1.6 kVpp

Frequency f=1800 Hz

In order to investigate relationships among a bias voltage applied to the blade 26, thickness and dielectric constant of the high resistance layer 26c of the blade 26 and a degree of improvement in the image quality, the following experiments have been carried out. The gap D between the blade 26 and the developing sleeve 9 is 100 μm.

EXPERIMENT 1

As the high resistance layer 26c of the blade 26, a polyethylene sheet having a dielectric constant εr=2 was used with different thicknesses t=10, 20, 50, 100, 500 and 1000 μm. Different DC voltages Vdc=−1200, −1150, −1100, −1050, −1000, −900, −800 and −600 V were applied to the blade 26. With these conditions the developing operations were carried out, and the image qualities were evaluated.

Figure 8:
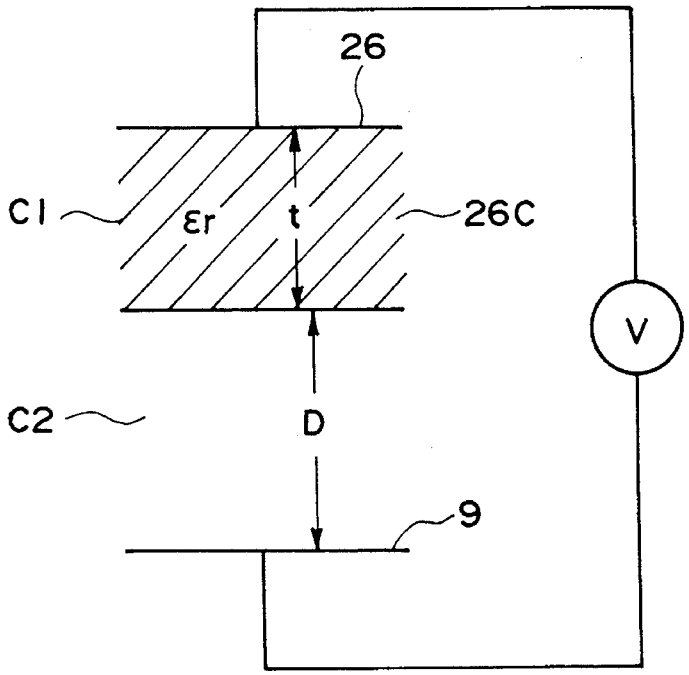
FIG. 8 is a circuit diagram of an equivalent circuit of a developer regulating portion of the developing apparatus of FIG. 7.

It is believed that the high resistance layer 26c in the portion where the blade 26 and the developing sleeve 9 are faced is a parallel plate having an electrostatic capacity (capacitance) CI and that a gap D between the blade 26 and the developing sleeve 9 is in the form of a parallel plate having an electrostatic capacity of C2. Then, an equivalent circuit is deemed as shown in FIG. 8 (a series of the electrostatic capacitances C1 and C2). With the potential difference v between the blade and the developing sleeve 9, the electric field ED produced in the cap D between the blade 26 and the developing sleeve is:

$$ED=v/(D+t/\epsilon r)\ [V/m]$$

In this embodiment, the developing bias voltage applied to the developing sleeve was in the form of a rectangular wave, and the bias voltage applied to the blade 26 was a DC voltage, and therefore, the electric field ED had two levels.

Table 1 shows the result of evaluation of the image quality, the strength of the electric field in the direction of removing the toner from the developing sleeve 9 of the electric field produced between the blade and the developing sleeve.

EXPERIMENT 2

As the high resistance layer 26c of the blade 26, use was made with phenol resin having a specific dielectric constant εr=5. Similarly to Experiment 1, the developing operations were performed with different thicknesses of the high resistance layer and the blade bias voltage Vdc, and the produced images were evaluated. The results are shown in Table 2.

TABLE 1

| Thickness of high resistance | εr = 2 | | | | | | | |
|---|---|---|---|---|---|---|---|---|
| | Blade bias VDC (V) | | | | | | | |
| layer t (μm) | −1200 | −1150 | −1100 | −1050 | −1000 | −900 | −800 | −600 |
| 10 | N | F | G | G | G | G | G | G |
| | 0 | 0.48 | 0.95 | 1.43 | 1.90 | 2.85 | 3.81 | 5.71 |
| 20 | N | F | G | G | G | G | G | G |
| | 0 | 0.45 | 0.91 | 1.36 | 1.82 | 2.73 | 3.64 | 5.45 |
| 50 | N | F | F | G | G | G | G | G |
| | 0 | 0.40 | 0.80 | 1.20 | 1.60 | 2.40 | 3.20 | 4.80 |
| 100 | N | F | F | G | G | G | G | G |
| | 0 | 0.33 | 0.67 | 1.00 | 1.34 | 2.00 | 2.67 | 4.00 |
| 200 | N | F | F | F | G | G | G | G |
| | 0 | 0.25 | 0.50 | 0.75 | 1.00 | 1.50 | 2.00 | 3.00 |
| 500 | N | F | F | F | F | F | G | G |
| | 0 | 0.14 | 0.28 | 0.42 | 0.56 | 0.84 | 1.14 | 1.71 |
| 1000 | N | N | F | F | F | F | F | G |
| | 0 | 0.08 | 0.16 | 0.24 | 0.32 | 0.48 | 0.67 | 1.00 |

Upper: Image quality evaluation
G . . . Good
F . . . Slightly low image density but practical
N . . . Low image density
Lower: Calculated v/(D+t/εr) (× $10^6$ V/m)

TABLE 2

| Thickness of high resistance layer t (μm) | εr = 2 Blade bias VDC (V) −1200 | −1150 | −1100 | −1050 | −1000 | −900 | −800 | −600 |
|---|---|---|---|---|---|---|---|---|
| 10 | N | F | G | G | G | G | G | G |
| | 0 | 0.40 | 0.98 | 1.47 | 1.96 | 2.94 | 3.92 | 5.86 |
| 20 | N | F | G | G | G | G | G | G |
| | 0 | 0.48 | 0.96 | 1.44 | 1.92 | 2.88 | 3.85 | 5.77 |
| 50 | N | F | F | G | G | G | G | G |
| | 0 | 0.45 | 0.90 | 1.35 | 1.80 | 2.73 | 3.64 | 5.45 |
| 100 | N | F | F | G | G | G | G | G |
| | 0 | 0.42 | 0.84 | 1.26 | 1.68 | 2.50 | 3.33 | 5.00 |
| 200 | N | F | F | G | G | G | G | G |
| | 0 | 0.36 | 0.72 | 1.00 | 1.44 | 2.14 | 2.86 | 4.23 |
| 500 | N | F | F | F | G | G | G | G |
| | 0 | 0.25 | 0.50 | 0.75 | 1.00 | 1.50 | 2.00 | 3.00 |
| 1000 | N | N | F | F | F | G | G | G |
| | 0 | 0.17 | 0.34 | 0.51 | 0.68 | 1.00 | 1.33 | 2.00 |

Upper: Image quality evaluation
G . . . Good
F . . . Slightly low image density but practical
N . . . Low image density
Lower: Calculated v/(D+t/εr) (× $10^6$ V/m)

As will be understood from Tables 1 and 2, the image quality is improved with decrease of the thickness t of the high resistance layer 26*c* and with increase of the blade bias voltage Vdc, and the preferable ranges of the thickness t and the bias voltage Vdc increase with increase of the specific dielectric constant of the high resistance layer 26*c*.

As will be understood from Tables 1 and 2, the image quality is improved with an increase of the strength of the electric field (calculated value) in the direction of removing the toner from the developing sleeve 9 of the electric field produced in the gap between the blade 26 and the developing sleeve 9. The results of the electric field strength are summarized as shown in Table 3 from Tables 1 and 2 on the basis of experiments 1 and 2.

TABLE 3

| Electric field intensity (calculations) | Image quality evaluation |
|---|---|
| ≧0.9 × $10^6$ V/m | G |
| ≧0.14 × $10^6$ V/m | F |
| ≦0.08 × $10^6$ V/m | N |

From the foregoing the following results are obtained. When it is assumed that a high resistance layer 26*c* at the position where the blade 26 and the developing sleeve 9 are opposed is considered as a parallel plate capacitance, that the gap D between the blade 26 and the developing sleeve 9 is considered as parallel plate electrostatic capacitance, that the electrostatic capacitances are connected in series, that a potential difference between the blade 26 and the developing sleeve 9 is v. It is satisfactory that the electric field ED produced in the gap D between the blade 26 and the developing sleeve.

$$ED=v/(D+t/\epsilon r)\ [V/m]$$

is not less than 0.90×$10^6$ V/m, preferably not less than 1×$10^6$ V/m. If this is satisfied, then the strength of the electric field is enough to unbind the toner to remove the high charge toner layer and the foreign matter or the like. Therefore, the non-uniformity in the toner application and the charging is eased to provide proper developing, thus permitting high quality image formation. The provision of the high resistance layer 26*c* of the blade 26 is effective to avoid non-uniform electric discharge attributable to the leakage of the blade bias voltage to the developing sleeve 9.

A further embodiment will be described. This embodiment is similar to that of FIG. 7, but a DC bias is used for the developing bias voltage applied to the developing sleeve 9, and a DC biased AC voltage was used as the bias voltage applied to an elastic blade 26.

The blade 26 comprises an electrically conductive rubber layer 26*b* of carbon-dispersed EPDM bonded to the supporting metal plate 26*a*, and a high resistance layer 26*c* of polyamide resin (εr=3) having a thickness of 20 μm on the surface of the conductive rubber layer 26*b*.

A negatively chargeable toner having a particle size of approx. 6 μm was used, and the developing bias voltage applied to the developing sleeve as:

DC voltage *Vdc*=−400 V

The blade bias voltage to the blade was:

DC voltage *Vdc*=−400 V

AC voltage:

Rectangular wave

Amplitude Vac=1.6 kVpp

Frequency f=1800 Hz

The gap D between the blade and the developing sleeve is 100 μm, and the strength of the electric field in the direction of removing the toner from the developing sleeve 9 to the blade 26 is:

$$\begin{aligned} ED &= v/(D+t/\epsilon r) \\ &= \{700-(-400)\}/\{100\times10^{6}+20\times10^{-6}/3\} \\ &= 10\times10^{6}\quad [V/m] \end{aligned}$$

This satisfies the condition of not less than 1×$10^6$ V/m.

In this embodiment, the high quality of the images was produced through proper development.

Figure 9:
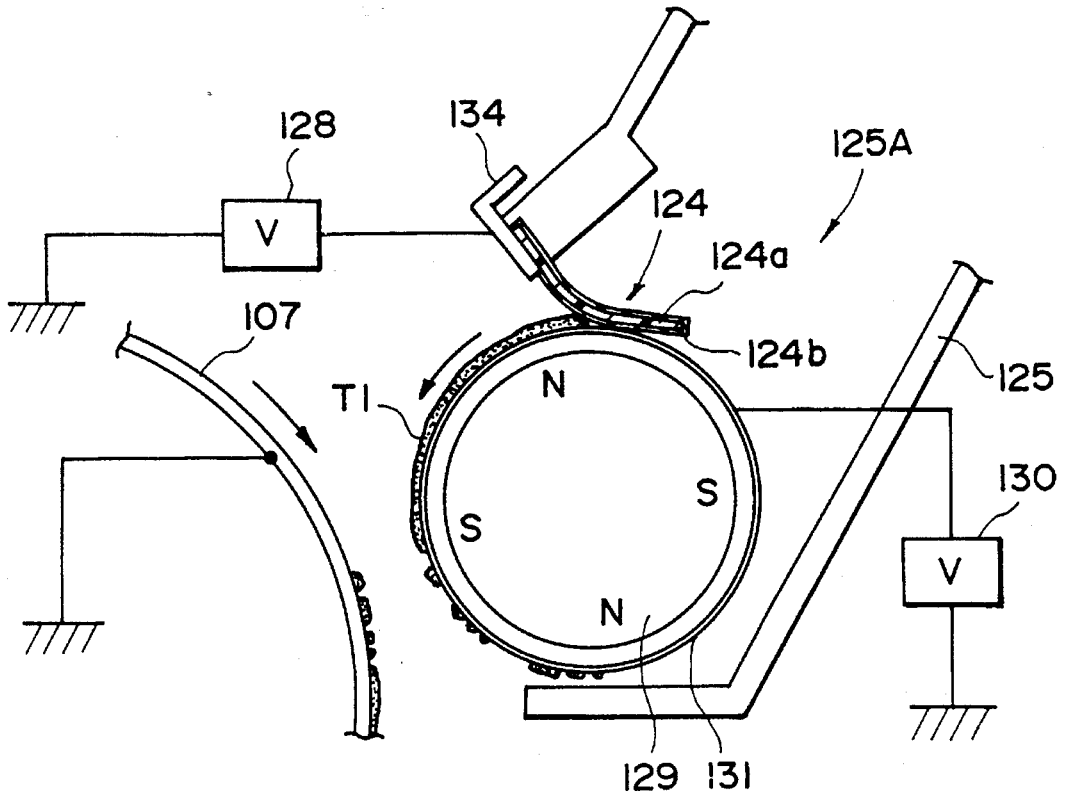
FIG. 9 is a sectional view of a developing apparatus according to a further embodiment of the present invention.

FIG. 9 shows a further embodiment. The developing device 125A comprises a developer container 125 for accommodating one component magnetic developer, a developing sleeve 131 rotatably disposed in an opening of the developer container 125 so as to be faced to the photosensitive drum 107, a magnet roller 129 stationarily disposed in the developing sleeve 131 by being fixed to the frame of the developing apparatus, and an elastic blade 124 elastically contacted to the developing sleeve 131. The developing sleeve 131 carries the magnetic toner T1 on the surface thereof by the magnetic force of the magnet roller 129, and it rotates. By doing so, the toner T1 is supplied to the developing zone where the developing sleeve is faced to the photosensitive drum 107, by which a latent image formed on the photosensitive drum 107 is developed.

According to this embodiment, the elastic blade is fixed at a position above the developing sleeve 131 of the developer container 125 by a metal plate 134 in the manner that it is contacted to the developing sleeve 131 counterdirectionally. At this time, the elastic blade 124 is given a rigidity by the metal plate 134. The elastic blade 124 is bonded to the metal plate 134 with electrically conductive hot-melt bonding material.

By contacting counterdirectionally the elastic blade 124 to the developing sleeve 131, the toner application is more stable onto the developing sleeve 131 than in the case of codirectional contact. This is because only toner having sufficient triboelectrical potential is applied on the developing sleeve 131 and is passed through the contact area with the elastic blade 124, by the counterdirectional contact. In the case of the codirectional contact, this effects are not achieved.

Figure 10:
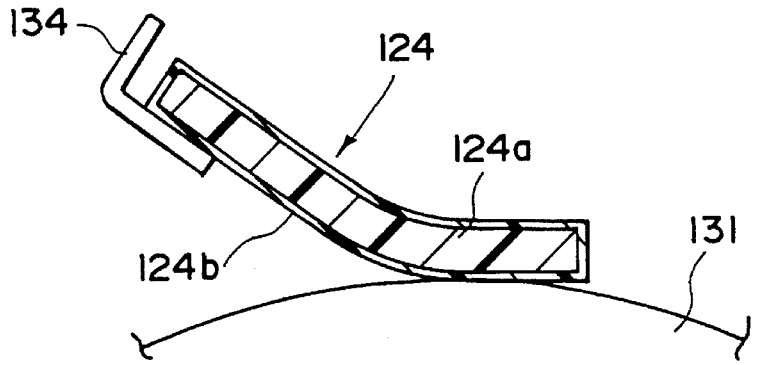
FIG. 10 is an enlarged sectional view of an elastic blade used in the developing apparatus of FIG. 9.

The elastic blade, as shown in FIG. 10, comprises conductive layer **124*a* of conductive elastic material and an insulating layer 124*b* on such a surface thereof close to the developing sleeve 131**, at least.

The conductive elastic member constituting the conductive layer **124*a* may be composed of urethane rubber plate containing conductive particles such as carbon or the like, stainless steel, phosphor bronze or another metal plate. In a case of a urethane rubber plate, the thickness is approx. 0.5–3 mm, and in the case of a metal plate, the thickness is approx. 30–200 μm. The insulating layer 124*b* is composed of high polymer resin material, such as nylon resin, polyester resin or acrylic resin or the like, as suitable resin materials. Among them, the nylon resin is most suitable from the standpoint of mechanical strength and charging property. The thickness of the insulative layer 124*b*** is preferably 10–50 μm from the standpoint of mechanical strength and the strength of the electric field.

The developing sleeve 131 is composed of electrically conductive material, and the developing sleeve 131 is supplied from a high voltage source 130 a developing bias voltage in the form of a DC biased AC voltage, by which the toner T1 on the developing sleeve 131 transferred to the latent image on the photosensitive drum 107 in the developing zone.

In the embodiment, an alternating electric field is produced between the elastic blade 124 and the developing sleeve 131. To accomplish this, the elastic blade 124 is electrically grounded, or a DC voltage is applied to the elastic blade 124 from a high voltage source 128 connected to the elastic blade 124, or an AC voltage or a DC biased AC voltage having a different phase from that of the AC bias voltage applied to the developing sleeve 131 is applied to the elastic blade 124 by a high voltage source 128.

By doing so, an alternating electric field is applied to the toner T1 between the elastic blade 124 and the developing sleeve 131, so that toner deposited on the surface of the elastic blade 124 or the toner layer that is strongly deposited due to the electrostatic mirror force onto the surface of the developing sleeve, can be removed. Therefore, the ghost or fog of the image described in the introductory part of the specification can be prevented.

In this embodiment, the thickness of the toner layer on the developing sleeve 131 is smaller than in the prior art, by which the individual particles of the toner are contacted to the elastic blade 125, so that the individual toner particles are sufficiently charged electrically. By doing so, the toner particles are uniformly charged, and as a result, the resultant images are sharp, thus improving the image quality.

As for the layer thickness of the toner layer, it is preferably thin, such that the height of the chains of the toner in the developing zone is 10–1000 μm, approximately.

However, if the individual toner particles are charged, some toner particles may be overcharged. The ghost or fog is produced even when the amount of the charge of the toner is too large. However, in this embodiment, the alternating electric field is applied between the blade 124 and the developing sleeve 131, and therefore, this defects can be prevented, as will be understood from FIGS. 11 and 12. In this embodiment, the elastic blade 124 is electrically grounded.

Figure 11:
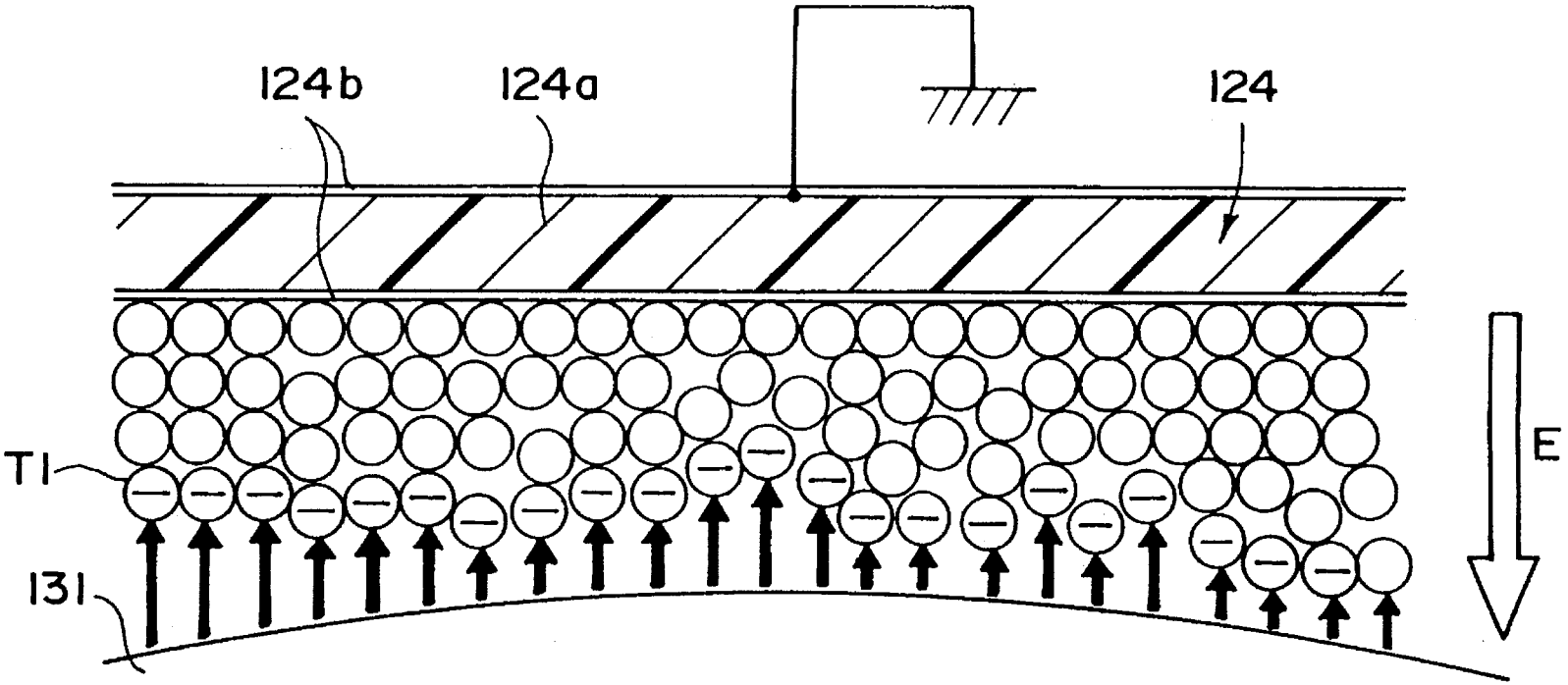
FIG. 11 is a sectional view illustrating the force applied to the toner by the electric field provided by a blade bias in the neighborhood of contact between the elastic blade and the developing sleeve when the electric field extends from the elastic blade to the developing sleeve.
Figure 12:
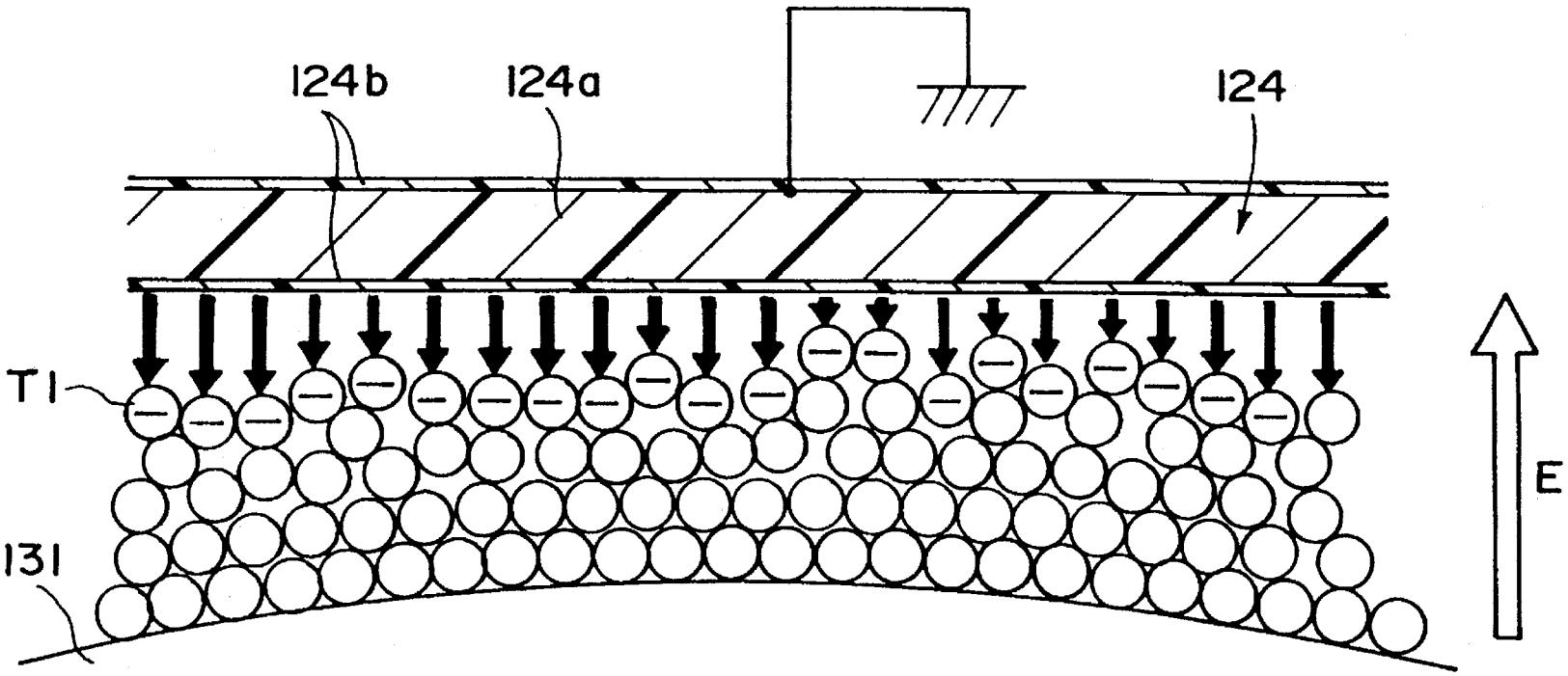
FIG. 12 is a similar sectional view illustrating force applied to the magnetic toner by the electric field provided by the blade bias when the electric field is extended from the developing sleeve to the elastic blade.

As shown in FIG. 11, when the alternating electric field E by the developing bias voltage applied to the developing sleeve 131 is directed from the elastic blade 124 to the developing sleeve 131, the developing sleeve 131 is of the negative polarity so that the negatively charged toner T1 is attracted to the elastic blade 124. When the electric field E is directed from the developing sleeve 131 to the elastic blade 124 on the contrary, as shown in FIG. 12, the developing sleeve 131 was a positive polarity, so that the negatively charged toner T1 is attracted to the developing sleeve 131. By repeating the alternating attractions of the toner particles by the electric field, the toner T1 is removed from the surface of the elastic blade 124 and the surface of the developing sleeve 131.

Usually, the particle size of the magnetic toner T1 is no less than 10 μm in the prior art. However, fine particle toner having the particle size of 5–8 μm is recently used. The fine particle toner significantly improves the image quality because of the small particle size, but the increase of the surface area of the toner particles tends to produce ghost or fog in the image. Therefore, this embodiment is particularly suitable when the magnetic toner T1 is fine particle toner.

In this embodiment, since the particle size of the magnetic toner T1 is small, and the thickness of the toner layer on the sleeve 131 is small, it is possible to sufficiently charge the individual particles of the toner T1. Even if the charge amount of the toner increases such that the toner is deposited on the surfaces of the developing sleeve of the elastic blade 124, the toner can be removed, and therefore, the proper amount of the charge is provided. The voltage applied to the elastic blade 124 hardly produces electric current because the surface of the elastic blade 124 is coated with the insulative layer **124*b***.

In this embodiment, the elastic blade 124 is contacted to the surface of the developing sleeve 131 by the elasticity thereof with the pressure of 5–50 g/cm (line pressure). Microscopically, between the elastic blade 124 and the developing sleeve 131, there are gaps of several microns, but fundamentally they are contacted. When the developing sleeve 131 starts to rotate, the toner is conveyed thereon, and the toner is regulated into a thin layer of the toner by the elastic blade 124.

The thickness of the toner layer on the developing sleeve 131 is dependent on the contact pressure of the elastic blade 124, the width of contact, the surface roughness and material of the surface of the developing sleeve 131, the process speed, and the particle size and material of the toner. Accordingly, by selecting proper conditions, the layer thickness of the toner on the developing sleeve 131 can be controlled. It is preferable that the thickness is such that the height of chains of the toner particles is 10–100 μm approximately in the developing zone.

According to this embodiment, foreign matter between the elastic blade 124 and the developing sleeve 131 can be removed, and therefore, image defects such as white stripes can be effectively prevented. More particularly, since the elastic blade 124 is in contact with the developing sleeve 131, foreign matter larger than the toner particles in the toner, namely, paper dust or coagulated toner, for example, are easily introduced between the elastic blade and the developing sleeve with the possible result of non-uniform toner application on the developing sleeve, and therefore, non-uniform development. According to this embodiment, however, the toner is vibrated between the elastic blade and the developing sleeve, and therefore, foreign matter interposed therebetween can be easily removed.

Specific examples will be described. The developing sleeve 131 of the developing device 125A comprises a sleeve base having an outer diameter of 16 mm, coated with resin coating layer including carbon and graphite on the surface thereof so as to provide a surface roughness of Ra=0.5–3.0 μm. The elastic blade 124 comprises conductive urethane rubber and an insulative urethane rubber thereon having a thickness of 10 μm.

The average particle size of the magnetic toner T1 is 8–5 μm. The magnetic material of the toner is of magnetite, and the content of the magnetic material is approx. 30–60% by weight.

The elastic blade 124 is electrically grounded, and the developing sleeve 31 is supplied with an AC voltage having a peak-to-peak voltage 1600 V and a frequency of 1800 Mz biased with a DC voltage of −500 V. The gap between the photosensitive drum 107 and the developing sleeve 131 was 250–350 μm. The height of the chains of the magnetic toner particles on the developing sleeve 131 was approx. 50–80 μm in the developing zone.

With these conditions, the developing device 125A is incorporated in a laser beam printer with the process speed of 50 mm/sec. It has been confirmed that good images without ghost or fog and with small edge effect, could be provided.

In the foregoing, the gap between the photosensitive drum 107 and the developing sleeve 131 was 250–350 μm. However, it has been confirmed that the image quality is further improved with a gap of 150–200 μm. The AC component of the developing bias voltage has been reduced to 1200 V in the peak-to-peak voltage.

In the embodiment of FIG. 9, use was made of an elastic blade 124 comprising a phosphor bronze plate having a thickness of 100 μm and insulative urethane resin having a thickness 10 μm thereon. The process speed was 100 mm/sec. The gap between the photosensitive drum 107 and the developing sleeve 131 was 300 μm. In other respects, the conditions were the same as with the embodiment of FIG. 9. When the image forming operations were carried out with these conditions, the ghost, fog and edge effects could be significantly reduced.

In the embodiment of FIG. 9, the gap between the photosensitive drum 107 and the developing sleeve 131 was as large as 250–350 μm. In the present embodiment, the height of the chains of the magnetic toner T1 on the developing sleeve 131 can be reduced to 50–80 μm, and therefore, there is no problem even if the gap between the photosensitive drum and the developing sleeve is reduced to 100–200 μm. By doing so, the developing sleeve and the photosensitive drum are closer, and therefore, the electric lines of force extending from the electrostatic latent image on the surface of the photosensitive drum are directed more to the developing sleeve so that the edge effect is reduced. In addition, the distance through which the toner transfers is shortened, so that the image is more faithful to the latent image.

The insulative layer **124*b* of the surface of the elastic blade 124 was composed of insulative urethane rubber. However, the material of the insulative layer may be changed if the toner can be charged in consideration of the charging property of the toner T1**.

In the case of the negatively chargeable magnetic toner T1, nylon resin material is usable as the insulative layer **124*b* at the surface of the elastic blade 124. Then, the toner T1 can be charged higher to the negative polarity. As described hereinbefore, when the average particle size of the toner T1 is 5–8 μm, the number of small toner particles is large even if the thickness of the toner layer is reduced on the developing sleeve 131**, and it is difficult to sufficiently charge the individual particles of the toner. However, if nylon resin is used as the insulative layer as the surface of the elastic blade, then the individual toner particles can be charged to the negative polarity.

However, in that case, some toner particles are charged more strongly to the negative polarity with the result of increasing the ghost, fog and edge effects. However, as in this embodiment, if the alternating electric field is applied between the elastic blade 124 and the developing sleeve 131, then the strongly charged toner can be removed from the surface of the elastic blade and the developing sleeve, thus avoiding inconveniences such as ghost or the like. In addition, since the toner can be charged uniformly, the image quality can be made sharper.

Figure 13:
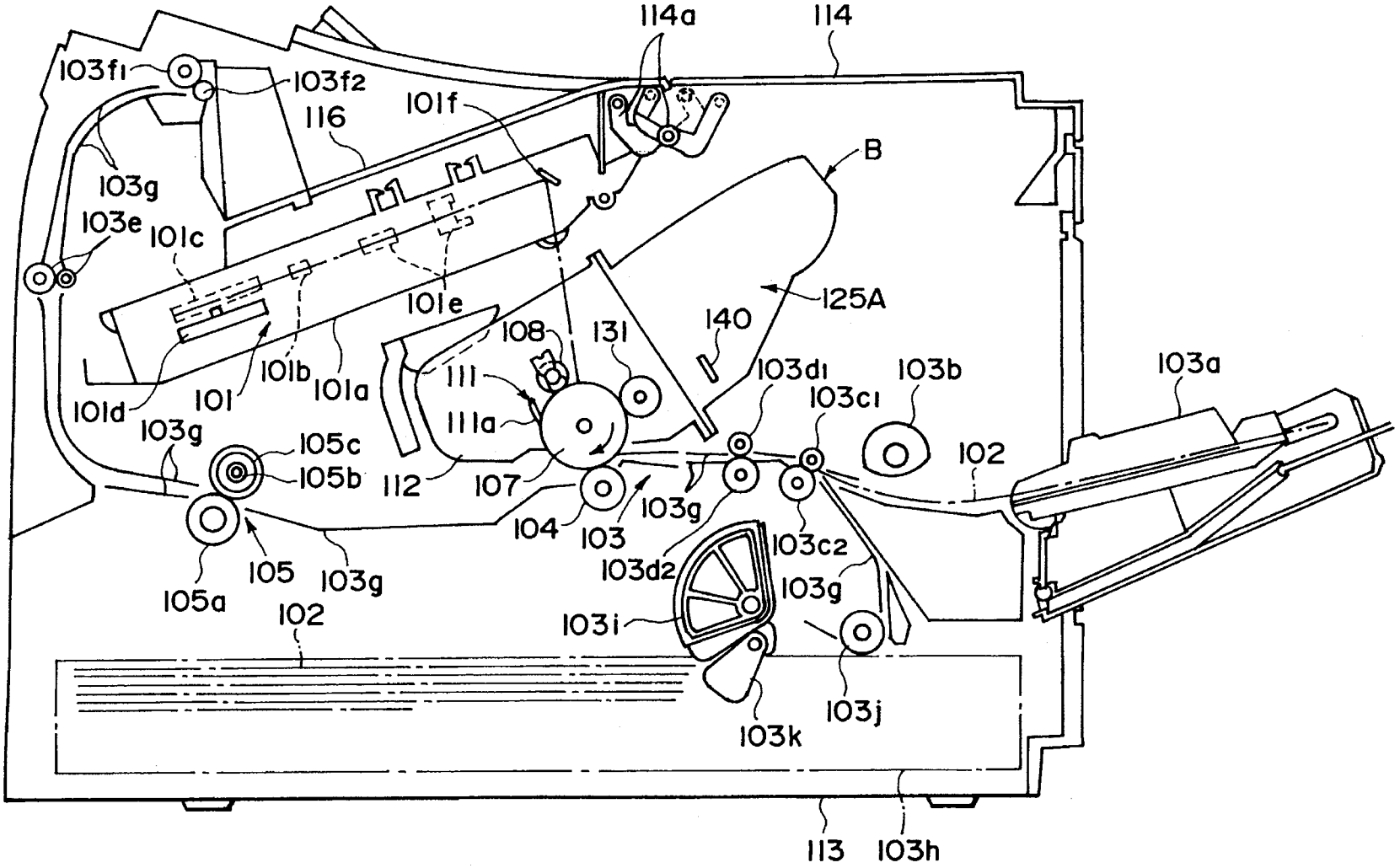
FIG. 13 is a sectional view of an entirety of an image forming apparatus loaded with a process cartridge containing a developing apparatus according to an embodiment of the present invention.
Figure 14:
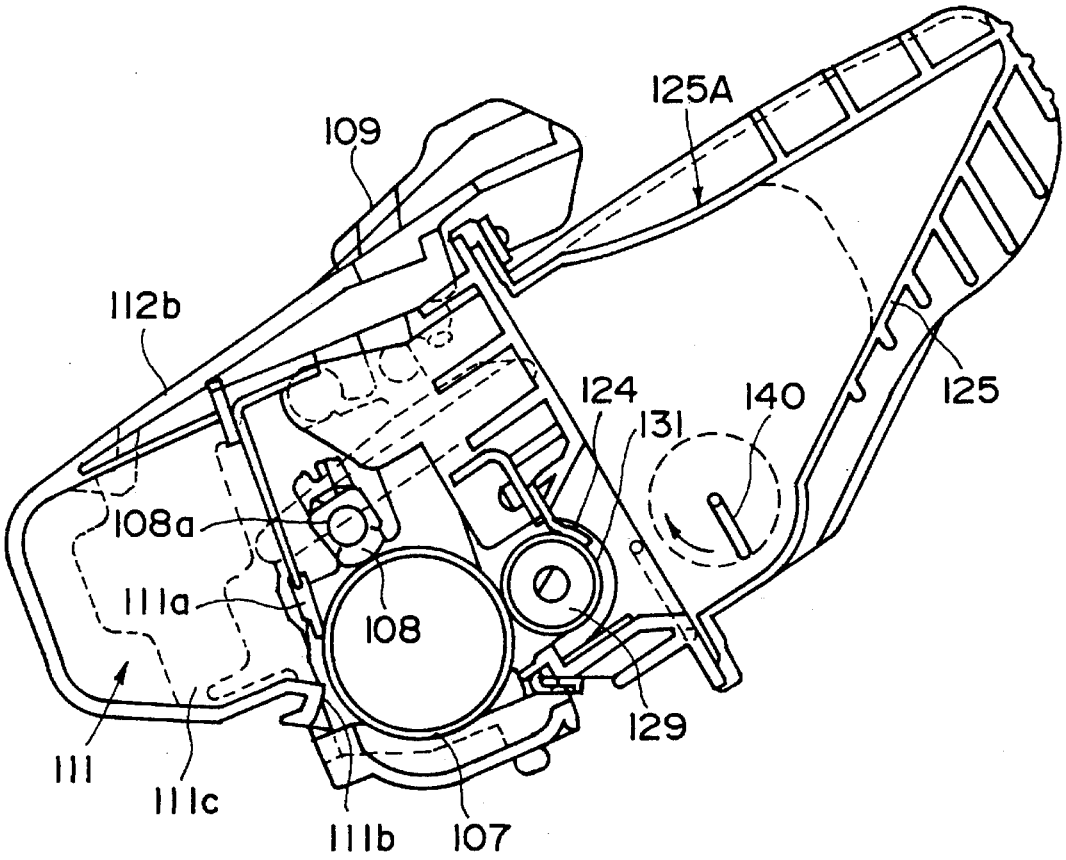
FIG. 14 is a sectional view of the process cartridge used in the apparatus of FIG. 13.

FIG. 13 shows a general arrangement of an image forming apparatus incorporating a process cartridge including the developing apparatus of this invention. FIG. 14 is an enlarged view of a process cartridge incorporated in the image forming apparatus of FIG. 13. The exemplary image forming apparatus is in the form of a laser beam printer. The developing device 125A is unified with the photosensitive drum 107 or the like into a process cartridge B, which is detachably mountable to the main assembly 113 of the image forming apparatus. The image forming apparatus fundamentally comprises an optical system 101, a recording material conveying means 103, a transfer roller 104, a fixing device 105 and the process cartridge B.

The optical system 101 projects a beam on the basis of image information provided by an external device, thus exposing the surface of the photosensitive drum 107 image-wisely so as to form a latent image thereon. Optical system 101 comprises a laser diode **101*b*, a polygonal mirror 101*c*, a scanner motor 101*d*, an imaging lens 101*e* and reflection mirrors 101*f*, contained in an optical unit 101*a* in the main assembly 113**.

When an image information signal is supplied from an external device such as a computer or word processor or the like, the laser diode **101*b* emits a laser beam in accordance with the image signal to the polygonal mirror 101*c* as image light. The polygonal mirror 101*c* rotates at high speed by the scanner motor 101*d*, and reflects the image light to the photosensitive drum by way of the imaging lens 101*e*, the reflection mirrors 101*f* and through an exposure opening 109**

(FIG. 14) of the process cartridge B, so that the surface of the photosensitive drum 107 is selectively exposed to the light, and therefore, a latent image is formed in accordance with the image information on the surface of the photosensitive drum 107.

The conveying means 3 for the recording material 2 comprises a number of rollers including a pair of registration rollers 103*d*1 and 103*d*2 or the like. The recording material 102 is in the form of a recording sheet, OHP sheet or another thin sheet or the like. In this embodiment, the recording material capable of being manually fed and being fed from a cassette.

In the case of manual feeding, as shown in FIG. 13, one or a plurality of recording materials 102 are set on the sheet feeding tray 103*a*. Upon the image formation start, a pick-up roller 103*b* of the conveying means 103 feeds out the recording material 102 from the feeding tray 103*a* into the apparatus. When a plurality of the recording material 102 are set, the materials are fed out one-by-one by means of separation rollers 103*c*1 and 103*c*2. The leading edge of the recording material 102 abuts the pair of registration rollers 103*d*1 and 103*d*2. In synchronism with the image forming operation, the registration rollers 103*d*1 and 103*d*2 start to rotate to feed the recording material 102 to an image transfer station where the transfer roller 104 is faced to the photosensitive drum 107.

The recording material 102 now having the transferred toner image, is fed to the fixing device 105, where the image is fixed, and the recording material is discharged to a discharge portion 116 by intermediate discharging rollers 103*e* and a pair of rollers 103*f*1 and 103*f*2. Between the rollers of the feeding means 103, there are provided guiding members 103*g* for guiding the recording material 102. A sheet feeding tray 103*a* constitutes an outer casing of the main assembly 113 when the apparatus is not operated.

In the case of cassette feeding, the recording materials 102 in the cassette 103*h* loaded in the main assembly 113 at the bottom thereof, are separated from the top one-by-one by a pick-up roller 103*i* and feeding roller 103*j* of the feeding means 103 to feed the recording material to pair of the registration rollers 103*d*1 and 103*d*2. After reaching the registration rollers 103*d*1 and 103*d*2, the recording material is fed in the same manner as in the case of the manual feeding. A reference numeral 103*k* below the pick-up roller 103*i* is a sensor for detecting presence or absence of the recording material 102 in the cassette 103*h*.

The transfer roller 103 is a transfer means for transferring only the recording material 102 the toner image formed on the photosensitive drum 107. The recording material is pressed to the photosensitive drum 107 by the transfer roller 104. The transfer roller 104 is supplied with a voltage having a polarity opposite to the polarity of the toner image on the photosensitive drum 107, so that the toner image is transferred onto the recording material 102 from the photosensitive drum 107.

The fixing device 105 functions to fix the toner image transferred onto the recording material 102. It comprises a driving roller 105*a* and a fixing roller 105*c* press-contacted to the driving roller 105*a*. The fixing roller 105*c* is driven by the driving roller 105*a* and has an inside heater 105*b*. The recording material 102 having the toner image is introduced between the driving roller 105*a* and the fixing roller 105*c*. During the passage thereof through the nip therebetween, a pressure is imparted by the rollers 105*a* and 105*c*, and the heat is applied from the fixing roller 105*c*, so that the toner is fused on the recording material 102 into a permanent fixed image.

The process cartridge B is mounted in the main assembly 113 by mounting means in the main assembly 113 of the apparatus. The cartridge mounting means comprises a cover 114 openable by a hinge 114*a* provided at an upper position of the main assembly 113, and an unshown guiding member on the left and right side walls of the main assembly 113. The cover 114 is opened, and the process cartridge B is inserted along the guiding members into the mounting space of the main assembly 113, so that the cartridge B is mounted in place in the main assembly 113. The process cartridge B comprises as a unit the developing device 125A and at least the photosensitive drum 107 as a process means. The process means may include in addition to the photosensitive drum 107, primary charging means for primary charging of the surface of the photosensitive drum 107, a developing device for developing a latent image on the photosensitive drum 107, cleaning means for removing the residual toner remaining on the surface of the photosensitive drum, or the like. In this example, the process cartridge B, as shown in FIG. 14, comprises a photosensitive drum 107, a primary charging roller 108 disposed at the periphery thereof, an exposure opening 109, a developing device 125A and cleaning means 111. They are incorporated in a frame 112 in a housing comprising first and second frames 112*a* and 112*b* as a unit, so as to provide a unit detachably mountable relative to the main assembly of the apparatus.

The photosensitive drum in this example is a cylindrical aluminum drum coated with an organic photosensitive layer. The photosensitive drum 107 is rotatable relative to the frame 112, and is rotatable in a direction indicated by an arrow in FIG. 9 in accordance with the image forming operation by the driving force transmitted from a driving motor (not shown) in the main assembly 113 through an unshown gear fixed to one longitudinal end of the photosensitive drum 107.

The primary charging roller 108 is a charging means for uniform primary charging of the surface of the photosensitive drum 107. In this example, the charging means is in the form of a charging roller 108. This is rotatably mounted to the frame 112. It is contacted to the photosensitive drum 107 (so-called contact charging method) to electrically charge the photosensitive drum 107. The charging roller 108 comprises an electrically conductive elastic layer on a metal roller shaft 108*a*. The elastic layer is coated with a high resistance layer and further with a protection film.

The conductive elastic layer is composed of carbon-dispersed elastic rubber such as EPDM or NBR or the like. It is effective to introduce the bias voltage for the primary charging supplied to the roller shaft 108*a* into the roller 108. The elastic layer of high resistance is composed of urethane rubber or the like. Because of this, even if the photosensitive drum 107 has a pin hole or the like, the current leakage from the charging roller 108 to the photosensitive drum 107 is suppressed, thus preventing sudden drop in the bias voltage. The protection layer is composed of N-methylmethoxynylon, which is effective to prevent deterioration of the surface of the photosensitive drum 107 by direct contact of the plastic material of the conductive elastic layer or the high resistance elastic layer with the photosensitive drum 107.

The primary charging roller 108 is driven by the photosensitive drum 107 by contact therewith, and is supplied with a bias voltage in the form of an AC biased DC voltage from an unshown voltage source to the roller shaft 108*a*, so that the surface of the photosensitive drum is uniformly charged to a predetermined potential.

The exposure opening 109 is provided to introduce the image light from the optical system 101 to the surface of the photosensitive drum 107 having been subjected to the above-described primary charging. The opening is formed in a top surface of the frame 112*b* adjacent to the photosensitive drum 107.

The cleaning means 111 comprises a cleaning blade 111*a* for removing residual toner remaining on the photosensitive drum 107 by contact with the moving surface of the photosensitive drum 107, and a receptor sheet 111*b* for receiving the toner removed by the blade 111*a*, because it is lightly in contact with the surface of the photosensitive drum 107 at a position below the blade 111*a*, and a residual toner container 111*c* for containing the removed toner as residual toner.

In the developing device 125A, as shown in FIG. 14, a developing sleeve is disposed in an opening faced to the photosensitive drum 107 in the developer container 125 for containing one component magnetic toner (not shown), and is rotatably supported with a small gap from the photosensitive drum 107. In the developing sleeve 131, a magnet roller 129 is non-rotatably disposed to retain the toner on the surface of the developing sleeve 131. At a position of the developer container 125 close to the developing sleeve 131, a toner feeding member 140 is rotatably mounted. The feeding member 140 is rotated in the direction of an arrow, so that the toner contained in the container 125 is fed toward the developing sleeve 131.

Above the developing sleeve 131, an elastic blade 124 is disposed in contact with the developing sleeve 131. The elastic blade 124 is effective to regulate the toner carried on the developing sleeve 131 into the developing zone where the developing sleeve 131 is faced to the photosensitive drum 107, and is also effective to apply triboelectric charge required for the development by the friction with the developing sleeve 131 and also to regulate the thickness of the toner layer to a thin layer.

In this embodiment, in the developing zone where the developing sleeve 131 of the developing device 125A is faced to the photosensitive drum 107, the height of the chains of the magnetic toner on the developing sleeve 131 is 10–100 μm. The elastic blade 124 is provided with an insulative layer at least at a side of the developing sleeve 131 of the conductive layer. Between the elastic blade 124 and the developing sleeve 131, an oscillating voltage is applied to produce an oscillating electric field.

Thus, a satisfactory developing operation can be performed with less ghost fog and edge effects. Good image formation can be accomplished using a process cartridge having unified developing device 125A and the photosensitive drum 107 or the like.

Figure 15:
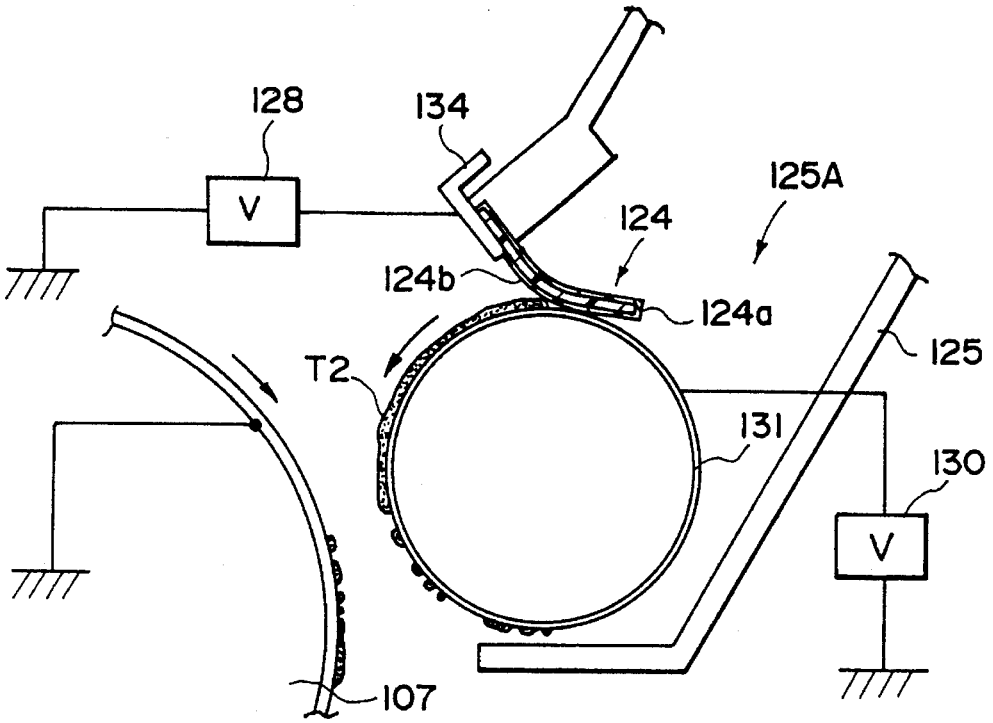
FIG. 15 is a sectional view of a developing apparatus according to a further embodiment of the present invention.
Figure 16:
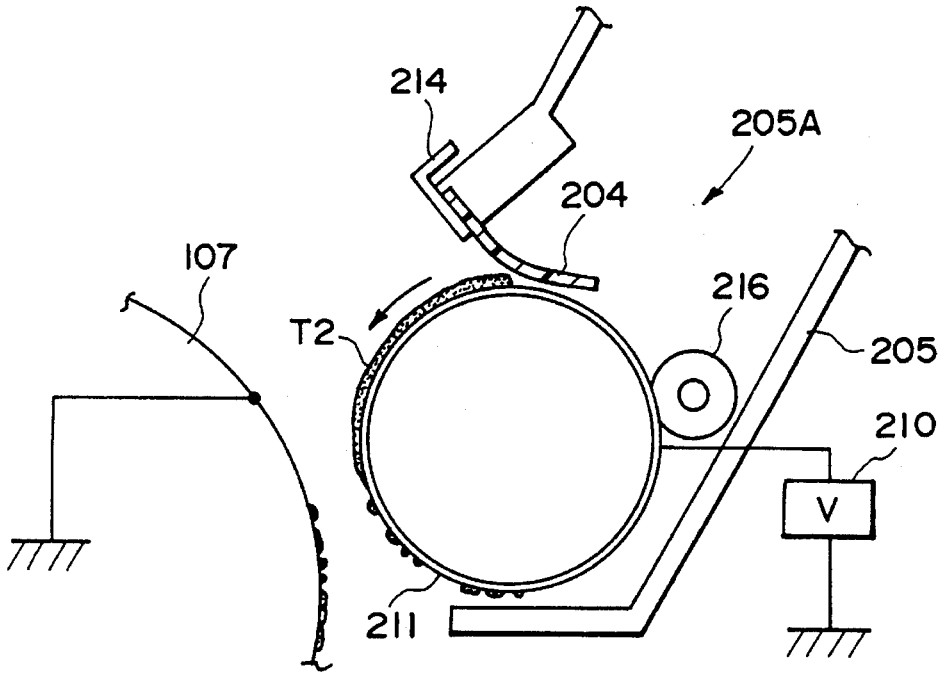
FIG. 16 is a sectional view of a developing apparatus.

FIG. 15 shows a developing device according to a further embodiment. In this embodiment, use is made of a one component non-magnetic developer as the developer. Even in the developing device using such a non-magnetic toner, problems similar to those with the developing device using the magnetic toner arise. Referring to FIG. 16, this will be described. The developing device 205A shown in FIG. 16 comprises a developer container 205 containing non-magnetic toner T2 (one component non-magnetic developer). A developing sleeve 211 is rotatably disposed in an opening faced to the photosensitive drum 107, and contains no magnet roller. In place thereof, an elastic roller 216 is disposed in contact with the developing sleeve 211 in the developer container 205.

The non-magnetic toner T2 in the developer container 205 is supplied and carried on the developing sleeve 211 by the elastic roller 216. A thickness of a layer of the toner T2 is regulated between the elastic blade 204 and the developing sleeve 211, and is strongly triboelectrically charged therebetween to such an extent that chains of the toner particles have a height of 10–60 μm, and the toner is carried toward the photosensitive drum 107 and is consumed for the development of the latent image on the photosensitive drum 107.

Similarly, during the developing operation, a developing bias voltage is applied between the developing sleeve 211 and the photosensitive drum 107. When the elastic blade 204 is composed of non-conductive material such as urethane rubber or the like, the metal plate 214 is electrically floated, or is maintained at the same potential as the developing sleeve 211. When the elastic blade 204 is composed of electrically conductive material such as stainless steel or the like, the metal plate 214 is maintained at the same potential as the developing sleeve 211 and the elastic blade 204.

The toner T2 remaining on the developing sleeve 211 after the developing action, is returned into the developer container 215 by rotation of the developing sleeve 211, and is scraped off by the elastic roller 216. Then, a fresh toner T2 is supplied onto the developing sleeve 211 and is carried thereon. By the scraping of the toner and the supply of the new toner by the elastic roller 216, the ghost or fog in the image resulting from the development can be prevented.

Figure 17:
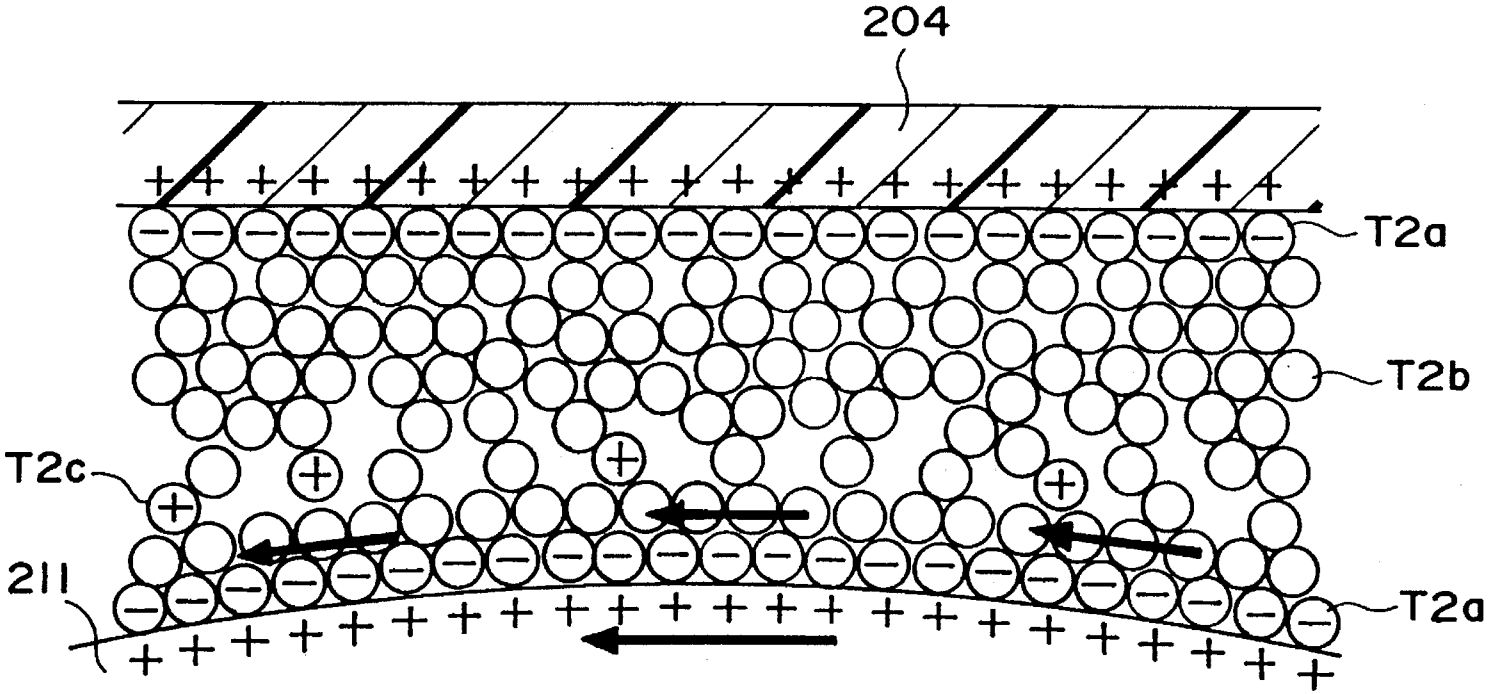
FIG. 17 is a sectional view of a part of a developing apparatus, illustrating behavior of non-magnetic toner in the neighborhood of contact between the elastic blade and the developing sleeve.

However, if the non-magnetic toner T2 is strongly charged by the triboelectric charging, and if the strongly charged toner T2 is brought close to the developing sleeve 211 or the elastic blade 204, then a significant electrostatic mirror force is produced therebetween with the result that the toner T2 is strongly deposited on the surfaces. In addition, magnetic forces or other physical attraction force are applied in addition to the electrostatic mirror force to such an extent that the toner T2 is not easily removed from the surface even if an elastic roller 216 is used. For this reason, as shown in FIG. 17, the surfaces of the developing sleeve 211 and the elastic blade 204 are covered with a plurality of layers of toner T2*a* with the result that the toner T2*b* supplied toward the developing sleeve 211 afterward is prevented from contacting the developing sleeve 211 and the elastic blade 204.

Particularly when images of low print ratio are continuously developed under low humidity condition, the toner T2*a* covering the developing sleeve 211 is further strongly charged with the result of charge non-uniformity or toner application non-uniformity or the like for the toner T2 with the possible result of improper image formation with non-uniformity. In the above-described state, the charge efficiency of the toner T2 decreases, and in addition, the amount of the toner charged to the opposite polarity (reverse toner) T2*c* tends to be relatively increased as a result of the increase of the triboelectric charge among toner particles T2. This results in deterioration of the image density, increase of the fog in the background of the image and increase of the edge effect, thus deteriorating the image quality.

Similarly, only if a part of the toner T2 on the developing sleeve 211 is consumed for the development, the difference in the amount of charge occurs between the toner newly carried and charged to a part where the developer has been consumed for the development and the toner not consumed for the development and retained on the developing sleeve 211. Due to the difference in the charge amount of the toner, ghost is produced in the subsequent image.

When foreign matter is introduced between the developing sleeve 211 and the elastic blade 204, the application of the toner T2 may be disturbed. The disturbance is not effectively removed in the prior art.

Use of the elastic roller 216 increases the cost, and it is particularly not preferable in the case that the developing device is in the form of a cartridge. If the elastic layer 216 is used, then the sealing against the toner in the roller bearing portions, becomes necessary with the result of complicated structure of the developing apparatus.

In the case of the non-magnetic toner T2, the toner has to be carried mainly only by the electrostatic force on the metal developing sleeve 211, and therefore, the individual particles of the toner are desirably charged to a target level of the amount of the charge. If the charging of the toner T2 is insufficient, then it falls out of the sleeve 211, thus contaminating the inside of the image forming apparatus. In order to retain the toner on the developing sleeve 211 substantially only by the electrostatic force, the thickness of the non-magnetic toner T2 layer is required to be thin on the developing sleeve. For this purpose, the individual particles of the toner T2 are more strongly charged than in the magnetic toner. Therefore, the ghost, fog and edge effects occur more easily.

This embodiment is intended to solve the problem when a one component non-magnetic toner is used.

The developing device 125A shown in FIG. 15 does not comprise a magnetic roller in the developing sleeve 131 in the developer container 125, and is not provided with an elastic roller in the container 125. The other structure is fundamentally the same as the developing apparatus of FIG. 9, and therefore, the detailed description is omitted for simplicity by assigning the same reference numerals as in FIG. 9 to the elements having the corresponding functions.

The one component non-magnetic toner T2 contained in the developer container 125 is carried on the developing sleeve 131 and conveyed by the rotation thereof. The toner T2 on the developing sleeve 131 is regulated by the elastic blade 124 contacted to the developing sleeve 131, and is strongly triboelectrically charged by the surface of the developing sleeve 131 and the surface of the elastic blade 124, and is formed into a thin layer having a thickness of 10–60 μm on the developing sleeve 131.

The elastic blade 124 has the similar structure as shown in FIG. 9. A thin insulative layer 124*b* is provided at least on the developing sleeve 131 side surface of the conductive layer 124*a* of electrically conductive elastic material. By a metal plate 134, it is fixed to the developer container 125 above the developing sleeve 131. The materials of the conductive layer 124*a* and the insulative layer 124*b* are fundamentally the same as in the embodiment of FIG. 9.

Similarly, the developing sleeve 131 has an electrically conductive property, and is supplied from a high voltage source 130 with a developing bias in the form of an AC biased DC voltage. At a developing position, the toner T2 on the developing sleeve 131 transfers to the latent image on the photosensitive drum 107.

At this time, an alternating electric field is produced between the elastic blade 124 and the developing sleeve 131. To accomplish this, the elastic blade 124 may be grounded, a DC voltage is applied to the elastic blade 124 from a high voltage source 128 connected to the elastic blade, or an AC voltage or a DC biased AC voltage having a phase different from that of the AC voltage of the developing bias voltage applied to the developing sleeve 131 from the developing bias voltage source 130, is applied to the elastic blade 124 from a high voltage source 128.

By doing so, in this embodiment, the toner T2 between the elastic blade 124 and the developing sleeve 131 is subjected to the alternating electric field, so that the toner deposited on the surface of the elastic blade 124 and the toner layer strongly deposited by the electrostatic mirror force on the surface of the developing sleeve 131 can be removed. Therefore, the ghost or fog in the image produced by the development can be reduced.

This embodiment is advantageous from the standpoint of fixing. The non-magnetic toner T2 usable for a full-color printer or copying machine, is fine particle non-magnetic toner. In order to assuredly retain such fine particle non-magnetic toner T2 on the developing sleeve 31, the individual particles of the toner are required to be sufficiently charged. If this is done, some of the toner particles are too strongly charged. If the amount of the charge of the toner is too large, then ghost or fog are easily produced.

According to this embodiment, the alternating electric field is formed between the blade 124 and the developing sleeve 131, and therefore, the defects can be avoided.

Figure 18:
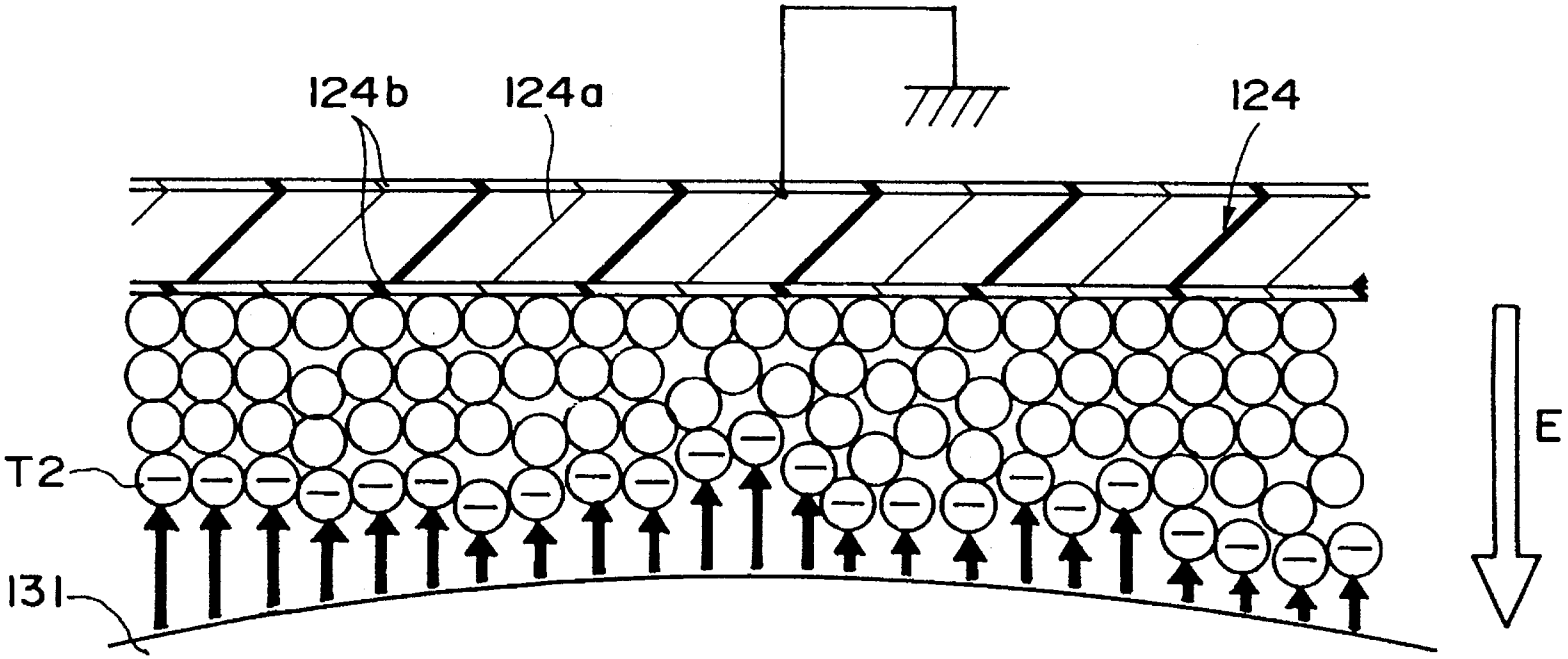
FIG. 18 is a sectional view of a part of a developing apparatus, illustrating force applied to the non-magnetic toner by an electric field provided by a blade bias voltage in the neighborhood of contact between the elastic blade and the developing sleeve, when the electric field extends from the elastic blade to the developing sleeve.
Figure 19:
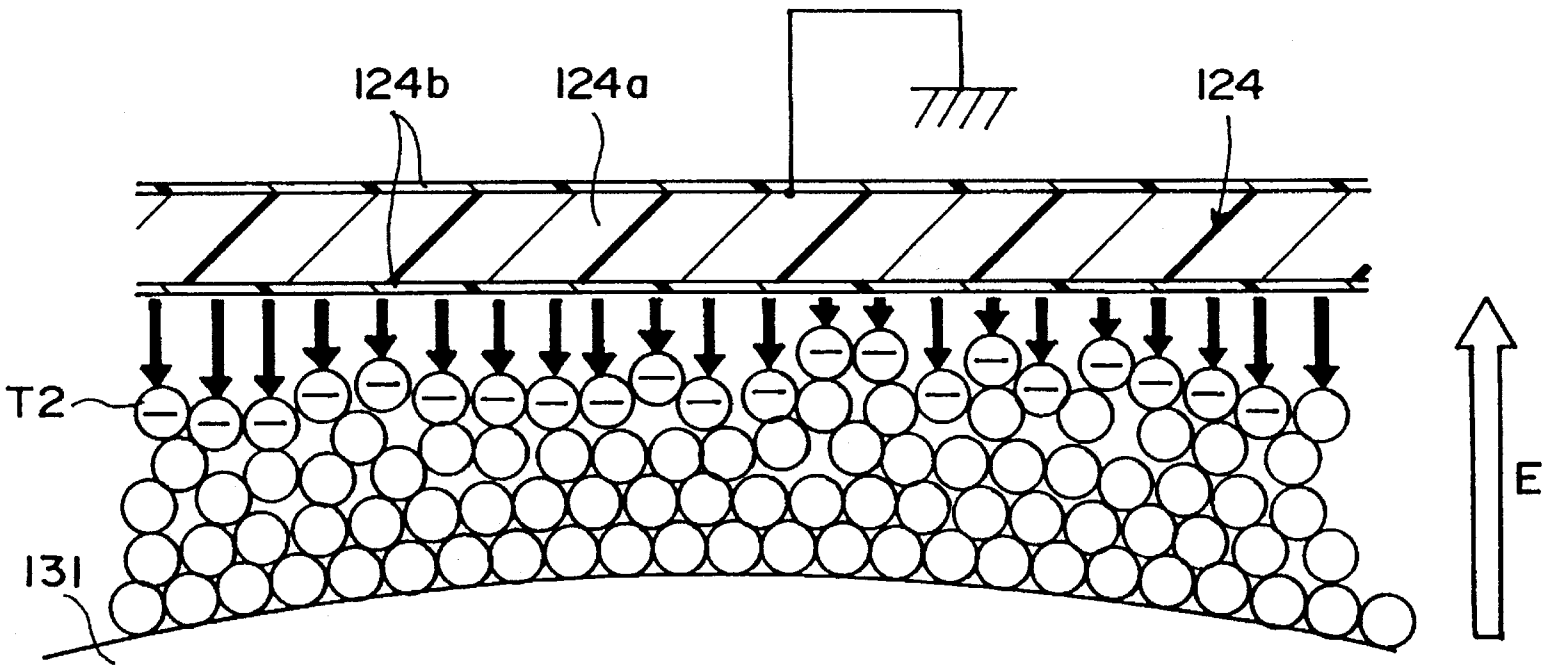
FIG. 19 illustrates the force applied to the non-magnetic toner when the electric field provided by the blade bias voltage extends from the developing sleeve to the elastic blade.

As shown in FIG. 18, when the alternating electric field E by the developing bias voltage applied to the developing sleeve 131 is directed from the elastic blade 124 (electrically grounded) to the developing sleeve 131, the developing sleeve 131 has negative polarity so that the negatively charged toner T1 is attracted to the elastic blade 124. When the electric field E is directed from the developing sleeve 131 to the elastic blade 124 on the contrary, as shown in FIG. 19, the developing sleeve 131 has a positive polarity, so that the negatively charged toner T1 is attracted to the developing sleeve 131. By repeating the alternating attractions of the toner particles by the electric field, the toner T1 is removed from the surface of the elastic blade 124 and the surface of the developing sleeve 131.

Usually, the particle size of the magnetic toner T1 is no less than 10 μm in the prior art. However, fine particle toner having the particle size of 5–8 μm is recently used. The fine particle toner significantly improves the image quality because of the small particle size, but the increase of the surface area of the toner particles tends to produce ghost or fog in the image. Therefore, this embodiment is particularly suitable when the magnetic toner T1 is fine particle toner.

In this embodiment, since the particle size of the magnetic toner T2 is small, and the thickness of the toner layer on the sleeve 131 is small, it is possible to sufficiently charge the individual particles of the toner T2. Even if the charge amount of the toner increases such that the toner is deposited on the surfaces of the developing sleeve of the elastic blade 124, the toner can be removed, and therefore, the proper amount of charge is provided. The voltage applied to the elastic blade 124 hardly produces electric current because the surface of the elastic blade 124 is coated with the insulative layer 124*b*.

In this embodiment, the elastic blade 124 is contacted to the surface of the developing sleeve 131 by the elasticity thereof with the pressure of 5–50 g/cm (line pressure). Microscopically, between the elastic blade 124 and the developing sleeve 131, there are gaps of several microns, but fundamentally they are contacted. When the developing sleeve 131 starts to rotate, the toner is conveyed thereon, and the toner is regulated into a thin layer of the toner by the elastic blade 124.

The thickness of the toner layer on the developing sleeve 131 is dependent on the contact pressure of the elastic blade 124, the width of contact, the surface roughness and material of the surface of the developing sleeve 131, the process speed, and the particle size and material of the toner. Accordingly, by selecting proper conditions for them, the layer thickness of the toner on the developing sleeve 131 can be controlled. It is preferable that the thickness of the toner layer is 10–60 μm. Since the elastic blade 124 is in contact with the developing sleeve 131, foreign matter larger than the toner particles in the toner, namely, paper dust and coagulated toner, for example, are easily introduced between the elastic blade and the developing sleeve with the possible result of non-uniform toner application on the developing sleeve, and therefore, non-uniform development. According to this embodiment, however, the toner is vibrated between the elastic blade and the developing sleeve, and therefore, the foreign matter interposed therebetween can be easily removed.

Specific examples will be described. The developing sleeve 131 of the developing device 125A comprises a sleeve base having an outer diameter of 16 mm, coated with a resin coating layer including carbon and graphite on the surface thereof so as to provide a surface roughness of Ra=0.5–1.0 μm. The elastic blade 124 comprises conductive urethane rubber and an insulative urethane rubber thereon having a thickness of 10 μm.

The average particle size of the magnetic toner T2 is 5–8 μm.

The elastic blade 124 is electrically grounded, and the developing sleeve 31 is supplied with an AC voltage having a peak-to-peak voltage 1600 V and a frequency of 1800 Hz biased with a DC voltage of −500 V. The gap between the photosensitive drum 107 and the developing sleeve 131 was 250–350 μm. The thickness of the toner layer was approx. 10–60 μm in the developing zone.

With these conditions, the developing device process speed of 50 mm/sec. It has been confirmed that good images without ghost or fog and with small edge effect, could be provided.

In the foregoing, the gap between the photosensitive drum 107 and the developing sleeve 131 was 250–350 μm. However, it has been confirmed that the image quality is further improved with a gap of 150–200 μm. The AC component of the developing bias voltage has been reduced to 1200 V in the peak-to-peak voltage.

In the embodiment of FIG. 16, use was made of an elastic blade 124 comprising a phosphor bronze plate having a thickness of 100 μm and insulative urethane resin having a thickness 10 μm thereon. The process speed was 100 mm/sec. The gap between the photosensitive drum 107 and the developing sleeve 131 was 300 μm. In other respects, the conditions are the same as with the embodiment of FIG. 9. When the image forming operations were carried out with these conditions, ghost, the fog edge effects could be significantly reduced.

In the embodiment of FIG. 9, the gap between the photosensitive drum 107 and the developing sleeve 131 was as large as 250–350 μm. In the present embodiment, the thickness of the developer layer can be reduced to 10–60 μm, and therefore, there is no problem even if the gap between the photosensitive drum and the developing sleeve is reduced to 100–200 μm. By doing so, the edge effect is reduced. In addition, the distance through which the toner transfers is shortened, so that the image is more faithful to the latent image.

Even when the non-magnetic toner T2 is used, the same result as with the magnetic toner fundamentally applies. The material of the insulative layer **124*b* at the surface of the elastic blade 124** may be another material capable or charging the toner in consideration of the charging polarity of the toner T2.

In the case of the negatively chargeable non-magnetic toner T2, the insulative layer **124*b*** may be nylon resin material for example, by which the toner T2 can be charged more strongly to the negative polarity.

When the particle size of the toner T2 is 5–8 μm (fine toner), the individual particles of the toner can be charged to the negative polarity. In this case, some of the toner particles are too strongly charged to the negative polarity with the possible result of increasing the ghost, fog and edge effects. In this embodiment, since the alternating electric field is applied between the elastic blade 124 and the developing sleeve 131, the toner strongly charged to the negative polarity and deposited can be removed from the surface of the developing sleeve or the surface of the elastic blade, and therefore, inconveniences such as ghost can be avoided. Since the toner can be charged uniformly to the negative polarity, the image quality is further sharpened.

Figure 20:
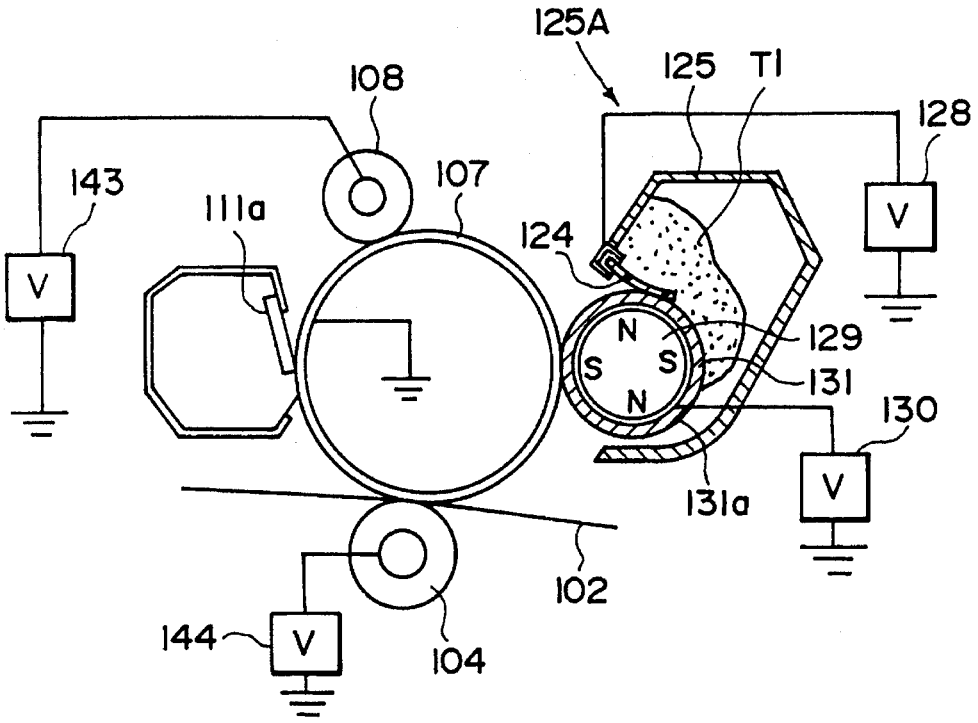
FIG. 20 is a sectional view of an image forming apparatus provided with a developing apparatus according to a further embodiment of the present invention.

FIG. 20 shows an image forming apparatus having a developing apparatus according to a further embodiment. First, the description will be made as to the problems intended to be solved by this embodiment. Generally speaking, the toner has a certain degree of particle size distribution. The fine toner particles having small diameter tend to receive too much triboelectric charge amount per unit volume, and therefore, they are accumulated on the surface of the developing sleeve by the mirror force of the fine toner to constitute a fine toner layer. This increases gradually.

Therefore, the majority of the toner particles having the particle size close to the average particle size, which are intended to perform a major and decisive role in the development of the latent image if it is charged to the proper level is prevented from properly performing the role by the fine toner layer with the result that the triboelectric charge provided by the friction with the surface of the developing sleeve is deteriorated, and therefore, the developing property is deteriorated. This deterioration results in a decrease in the image density, or the production of a sleeve ghost as a result of the influence of the hysteresis of the previous developed image to the next image development. In a non-contact development, when an image is reproduced with the density of not less than 600 dpi, the latent image can be more faithfully reproduced if the distance between the developing sleeve and the photosensitive drum (S-D gap) is decreased. However, the decrease of the S-D gap results in an increase of fog, and leakage of the developing bias under a low humidity condition. If the AC voltage component of the developing bias voltage is reduced in an attempt to prevent the leakage, then the image density is decreased.

This embodiment shown in FIG. 20 is intended to provide an image forming apparatus in which even if a fine toner layer is formed on the surface of the developing sleeve, the one component developer on the developing sleeve is properly charged, so that the resultant image is free of sleeve ghost or other defects.

As shown in FIG. 20, a charging roller 108 is contacted to the photosensitive drum 107, and a bias voltage is applied from a voltage source 143 to a core metal of the charging roller, so that the surface of the photosensitive drum is uniformly charged by the charging roller 108. The photosensitive drum 107 is exposed to image light through an unshown optical system so that an electrostatic latent image is formed. The latent imag formed on the photosensitive drum 107 is developed with a developer by the developing device 125A into a toner image.

The developing device 125A contains one component magnetic developer in the developer container 125. The developing sleeve 131 disposed in the developer container 125, in this embodiment, comprises an aluminum sleeve functioning as an electrode and a high resistance layer **131*a* thereon. The high resistance layer 131*a* may be applied on the aluminum sleeve base by a spray or dipping method using heat-curing resin such as phenol resin or the like in which carbon black, graphite or other conductive particles are dispersed. Thereafter, the material is heat-cured to provide a volume resistivity of $3\times10^{8}$–$1\times10^{10}$ ohm.cm with the film thickness of 5–20 μm. During the developing operation, the developing sleeve 131 is supplied with a developing bias voltage comprising an AC component having a peak-to-peak voltage of 200 V and a frequency of 1800 Hz and a DC component of −600 V from a voltage source 130**.

The elastic blade 124 disposed at a position of the container 125 above the developing sleeve 131, according to this embodiment, comprises an electrically conductive member such as conductive rubber (carbon dispersed EPDM), phosphor bronze, stainless sheet or the like. The surface of the elastic blade 124 is not provided with an insulative layer. In this embodiment, the elastic blade 124 is supplied with an oscillating voltage in the form of a DC biased AC voltage from the voltage source as the bias voltage. In this example, the bias voltage has a DC component of −800 V.

The toner image obtained through the development, is transferred onto a recording material 102 fed to the image transfer station where a transfer roller 104 is opposed to the photosensitive drum 107. Thereafter, it is fixed by an unshown fixing device. The toner remaining on the photosensitive drum 107 is removed by a cleaning blade 111*a* from the photosensitive drum 107 so as to be prepared for the next image forming operation.

In this embodiment, the surface of the developing sleeve 131 is coated with a high resistance layer 131*a*, and no excessive current flows between the developing sleeve 131 and the elastic blade, even if they are partly contacted directly with each other upon the start of a new developing device or at the time of the short of the toner.

According to this embodiment, the magnetic toner T1 carried on the developing sleeve 131 is triboelectrically charged by rubbing with the surface of the developing sleeve 131 during passage through the nip formed with the elastic blade 124, and is reciprocated between the developing sleeve and the elastic blade after passage through the nip, in accordance with a change in the strength and the direction of the electric field between the elastic blade and the developing sleeve.

For this reason, the high charge toner close to the surface of the developing sleeve 131 and the low charge toner at the surface portion of the toner layer, are mixed together, so that it can be avoided that the high charge amount toner is electrostatically attracted on the surface of the developing sleeve and obstruct the triboelectric charge of the other toner. Therefore, the low density or the sleeve ghost under a low humidity condition can be decreased. In addition, it is possible to increase the charge amount or to maintain the same stably, and the low density or sleeve ghost due to the moisture absorption of the toner under a high humidity condition, can be also avoided.

A further embodiment will be described. One of the features of this embodiment is the use of a toner having a volume average particle size of 4–9 μm as one component magnetic toner T1. The selection of the particle size is because when the latent image of not less than 600 dpi is to be developed, the reproducibility of fine lines is improved by the use of a toner having a particle size not more than 9 μm, and because when the toner is manufactured through a pulverizing method at preset, it is difficult to stably contain the magnetic material in the toner without increasing the cost, if the size is smaller than 4 μm.

When the size of the toner particle T1 is reduced, the surface per unit volume of the toner increases, and therefore, the amount of the electric charge per unit weight increases. The high charge amount toner having small particle size is strongly attracted electrostatically on the surface of the developing sleeve by the mirror force thereof. Therefore, when the size of the toner particles is reduced, the reduction of the density under a low humidity condition or the sleeve ghost are made worse.

Therefore, in this embodiment, the electric field applied to the toner adjacent the nip with the elastic blade 125 is increased, and the period thereof can be set to correspond to the toner property by using a DC biased AC voltage applied to the elastic blade. In this embodiment, the DC component is −900 V, and the AC component has a peak-to-peak voltage of 1500 V and a frequency of 3000 Hz.

In this case, not only the force of the electric field applied to the toner T1 is increased, but also a potential difference not less than a discharge starting voltage (550 V under normal temperature and normal pressure condition) is periodically produced between the elastic blade 24 and the toner layer surface, and therefore, it is possible to charge the toner on the developing sleeve 31.

Therefore, a low density image or sleeve ghost under a low humidity condition, which is a problem when fine magnetic toner T1 is used, can be significantly reduced. In addition, the density reduction due to the reduction of the triboelectric charge amount attributable to the moisture absorption of the toner under a high humidity condition can be improved.

Figure 21:
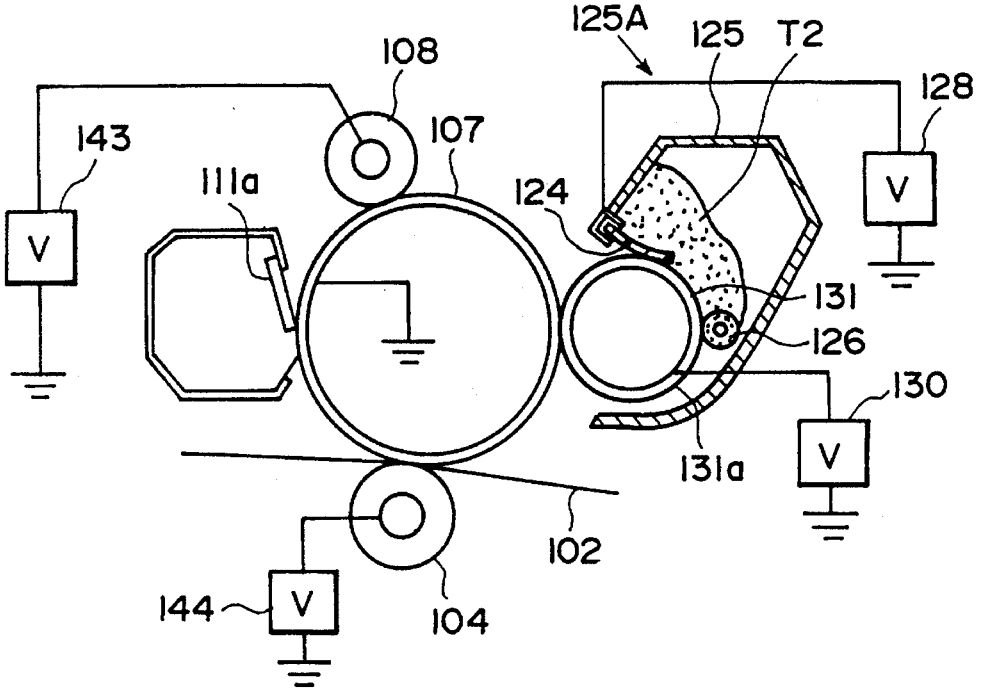
FIG. 21 is a sectional view of an image forming apparatus provided with a developing apparatus according to a further embodiment of the present invention.

FIG. 21 schematically shows an image forming apparatus provided with a developing apparatus according to a further embodiment. One of the features of this embodiment is the use of an insulative one component non-magnetic toner T2. The developing sleeve 131 is not provided with a magnet roller. In order to supply and carry the toner T2 on the developing sleeve 131, an elastic roller 126 in the form of a sponge roller is contacted to the developing sleeve 131 at a rear position of the developing sleeve 131 in the developer container 125.

In this embodiment, pigments used for the control of the resistance of the high resistance layer 131*a* formed on the surface of the developing sleeve 131 are composed of graphite. The graphite has a cleavage crystalline plane, and therefore, the parting property is excellent, and therefore, the contamination of the developing sleeve with the toner which easily occurs in the case of non-magnetic toner, can be prevented.

To the non-magnetic toner T2 carried on the developing sleeve 131, the electric charge is supplied to the toner T2 after passing by the elastic blade 124, by which the amount of the charge of the toner is made uniform, the density of the image is stabilized, and the sleeve ghost is reduced. Thus, a better developing operation than the prior art can be accomplished.

Figure 22:
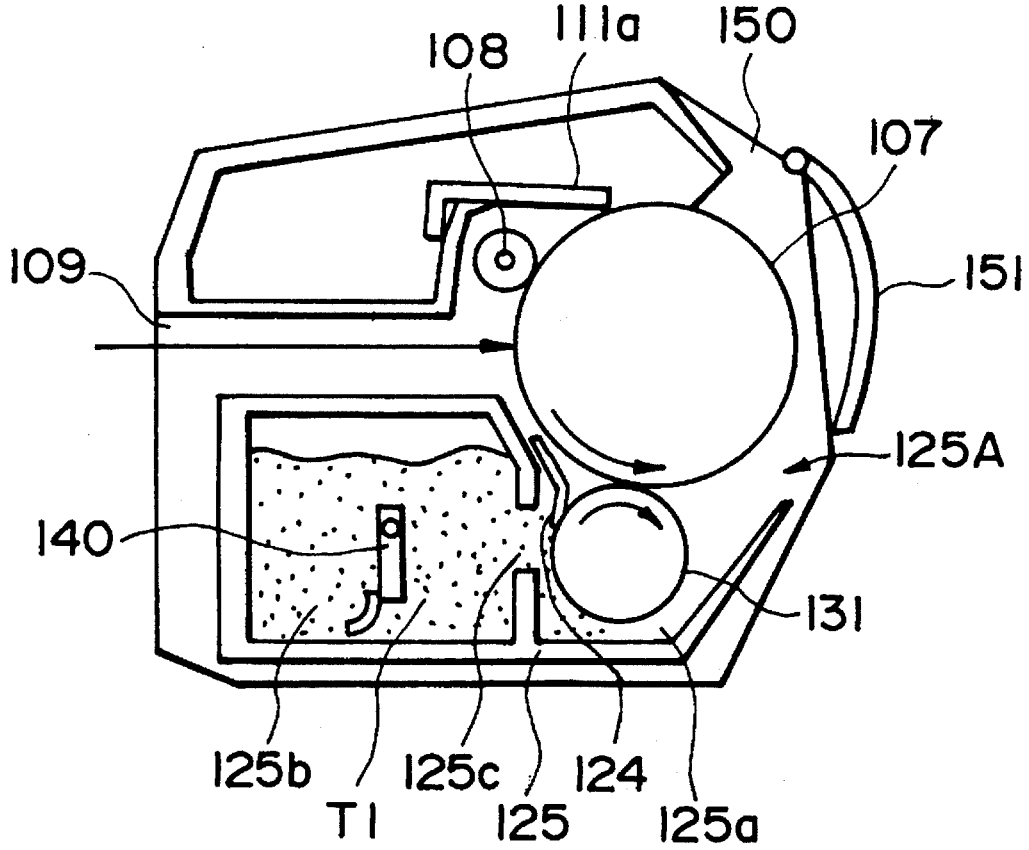
FIG. 22 is a sectional view of a process cartridge containing a developing apparatus according to an embodiment of the present invention.

FIG. 22 shows a process cartridge using the developing apparatus of this embodiment. Generally, the process cartridge comprises a photosensitive drum and at least one of the charging means, developing means and the cleaning means in the form of a cartridge, which is detachably mountable to a main assembly of the image forming apparatus. The consumable articles represented by the photosensitive drum and the developer are formed as a unit, so that the user can easily replace it, thus accomplishing a fundamentally maintenance-free image forming apparatus.

The structure of the process cartridge of this embodiment is fundamentally the same as the process cartridge B of FIG. 14. However, no insulative layer is provided on the surface of the elastic blade 124 of the developing apparatus 125A, and a high resistance layer is provided on the surface of the developing sleeve.

At one side of a casing 150 of the cartridge, a photosensitive drum 107 protected by a shutter 151 is disposed. The shutter 151 is opened when the cartridge is mounted into the image forming apparatus to provide an image transfer opening faced to the photosensitive drum 107. The image light from an image exposure apparatus outside the cartridge is introduced through the exposure opening 109 at the opposite side of the shutter 151 so as to permit exposure of the photosensitive drum 107 thereto.

The developing device 125A is at the bottom of the casing 150 of the process cartridge. In the developer container 125, a developer chamber 125*a* with the developing sleeve 131 below the photosensitive drum 107 is formed. At a side of the developing chamber 125*a*, a toner container 125*b* is formed for containing the one component magnetic toner T1. The toner T1 in the toner container 125*b* is fed into the developing chamber 125*a* through an opening 125*c* from the toner container 125*b* by a feeding member 140, so that it is supplied and carried on the developing sleeve 131.

The toner T1 carried on the developing sleeve 131 is regulated in the layer thickness thereof by the elastic blade 124 supplied with an oscillating bias voltage from an unshown voltage source. As described hereinbefore, adjacent the nip between the elastic blade 124 and the developing sleeve 131, the high charge amount toner distributed adjacent the sleeve surface of the toner layer on the developing sleeve and the low charge amount toner distributed adjacent the outside part of the toner layer, are mixed.

Therefore, uniform and stabilized charge is applied through the entire toner layer on the developing sleeve. Therefore, the electrostatic latent image formed on the photosensitive drum 7 can be properly developed without ghost or low image density.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus comprising:

a developer carrying member for carrying developer;

an elastic blade press-contacted to said developer carrying member to regulate a layer of developer formed on said developer carrying member, said elastic blade comprising an electrically conductive layer, and a high resistance layer located at a developer carrying member side of the conductive layer; and electric field generating means for forming an oscillating electric field between said developer carrying member and the electrically conductive layer;

where a maximum intensity of the oscillating electric field formed by said electric field generating means is not less than $10^6$ V/m.

2. An apparatus according to claim 1, wherein the maximum intensity of the oscillating electric field is not more than $10^8$ V/m.

3. An apparatus according to claim 1, wherein the oscillating electric field has a frequency of 10–10 KHz.

4. An apparatus according to claim 1, wherein the electrically conductive layer is composed of metal, and the high resistance layer is composed of rubber.

5. An apparatus according to claim 1, wherein the high resistance layer is disposed on a surface of the electrically conductive layer.

6. An apparatus according to claim 1, wherein said electric field generating means applies an oscillating voltage to each of said developer carrying member and the electrically conductive layer.

7. An apparatus according to claim 1, wherein the developer is a one component magnetic toner.

8. An apparatus according to claim 1, wherein the electrically conductive layer and the high resistance layer are each composed of rubber material.

9. An apparatus according to claim 1, wherein the oscillating electric field is an alternating electric field.

10. A developing apparatus comprising:

a developer carrying member for carrying one component magnetic developer to a developing zone;

an elastic blade press-contacted to said developer carrying member to regulate a layer of developer formed on said developer carrying member, said elastic blade comprising an electrically conductive layer, and a high resistance layer located at a developer carrying member side of the conductive layer; and electric field generating means for forming an alternating electric field between said developer carrying member and the electrically conductive layer;

wherein a height of chains formed by developer carried on said developer carrying member in the developing zone is smaller than a distance between a latent image bearing member and said developer carrying member, and is 10–100 μm.

11. An apparatus according to claim 10, wherein the electrically conductive layer is composed of metal, and the high resistance layer is composed of resin material.

12. An apparatus according to claim 10, wherein the high resistance layer is disposed on the electrically conductive layer.

13. An apparatus according to claim 10, wherein said electric field generating means applies an oscillating voltage to each of said developer carrying member and the electrically conductive layer.

14. A developing apparatus comprising:

a developer carrying member for carrying one component non-magnetic developer;

a regulating blade press-contacted to said developer carrying member for regulating a layer of developer on said developer carrying member, said elastic blade comprising an electrically conductive layer, and a high resistance layer at the developer carrying member side of said electrically conductive layer; and electric field generating means for generating an alternating electric field between said developer carrying member and the electrically conductive layer;

wherein a thickness of the layer of developer carried on said developer carrying member is smaller than a gap between a latent image bearing member and said developer carrying member, and is 10–60 μm.

15. An apparatus according to claim 14, wherein the electrically conductive layer is composed of metal, and the high resistance layer is composed of resin material.

16. An apparatus according to claim 14, wherein the high resistance layer is disposed on the conductive layer.

17. An apparatus according to claim 14, wherein said electric field generating means applies an oscillating voltage to each of said developer carrying member and the electrically conductive layer.

* * * * *

UNITED STATES PATENT AND TRADEMARK OFFICE

CERTIFICATE OF CORRECTION

PATENT NO. : 5,519,472

DATED : May 21, 1996

INVENTOR(S) : MASAKI OJIMA, et al.

It is certified that error appears in the above-indentified patent and that said Letters Patent is hereby corrected as shown below:

ON THE COVER PAGE

[56] References Cited

FOREIGN PATENT DOCUMENTS

"5019145" should read --5-019145--.

COLUMN 2

Line 12, "elastic the" should read --and elastic--.
Line 47, "are" should read --is--.
Line 67, "charge" should read --charged--.

COLUMN 5

Line 10, "rubber 26b" should read --rubber member 26b--.
Line 49, "water" should read --of water--.
Line 50, "then the" should read --the--.
Line 51, "the maximum" should read --then the maximum--.

UNITED STATES PATENT AND TRADEMARK OFFICE

CERTIFICATE OF CORRECTION

PATENT NO. : 5,519,472

DATED : May 21, 1996

INVENTOR(S) : MASAKI OJIMA, et al.

It is certified that error appears in the above-indentified patent and that said Letters Patent is hereby corrected as shown below:

COLUMN 7

Line 19, "the then" should read --then the--.
Line 40, "comprises" should read --comprising--.
Line 50, "2.5 mm, and" should read --2.5 mm,--.

COLUMN 8

Line 4, "F32 1800 Mz" should read --F=1800 Hz--.
Lines 46-49, "the fine" should read --a fine--.

COLUMN 10

Line 36, "with" should read --of--.

COLUMN 11

Line 12, "0.40" should read --0.49--; and "5.86" should read --5.88--.
Line 49, "When it" should read --It--.

UNITED STATES PATENT AND TRADEMARK OFFICE

CERTIFICATE OF CORRECTION

PATENT NO. : 5,519,472

DATED : May 21, 1996

INVENTOR(S) : MASAKI OJIMA, et al.

It is certified that error appears in the above-indentified patent and that said Letters Patent is hereby corrected as shown below:

COLUMN 13

Line 29, "this" should read --these--.
Line 53, "transferred" should read --is transferred--.

COLUMN 14

Line 20, "this" should read --these--.

COLUMN 15

Line 31, "8-5" should read --5-8--.

COLUMN 17

Line 11, "material" should read --material is--.
Line 18, "are" should read --is--.
Line 40, "pair of the" should read --the pair of--.
Line 48, "only the recording material 102" should read --only to the recording material 102,--.

UNITED STATES PATENT AND TRADEMARK OFFICE

CERTIFICATE OF CORRECTION

PATENT NO. : 5,519,472

DATED : May 21, 1996

INVENTOR(S) : MASAKI OJIMA, et al.

It is certified that error appears in the above-indentified patent and that said Letters Patent is hereby corrected as shown below:

COLUMN 18

Line 54, "sudden" should read --a sudden--.

COLUMN 19

Line 45, "ghost" should read --ghost,--.

COLUMN 20

Line 29, "forces" should read --force--; and "force" should read --forces--.

COLUMN 21

Line 2, "portions," should read --portions--.

COLUMN 22

Line 17, "negative" should read --a negative--.

UNITED STATES PATENT AND TRADEMARK OFFICE

CERTIFICATE OF CORRECTION

PATENT NO. : 5,519,472

DATED : May 21, 1996

INVENTOR(S) : MASAKI OJIMA, et al.

It is certified that error appears in the above-indentified patent and that said Letters Patent is hereby corrected as shown below:

COLUMN 23

Line 24, "device" should read --device 125A was incorporated in a laser beam printer with a--.
Line 42, "ghost, the fog" should read --the ghost, fog, and--.

COLUMN 24

Line 54, "imag" should read --image--.

COLUMN 25

Line 30, "short" should read --shortage--.
Line 60, "preset" should read --present--.

COLUMN 26

Line 3, "condition" should read --condition,--.

Signed and Sealed this

First Day of October, 1996

Bruce Lehman

*Attest:*

BRUCE LEHMAN

*Attesting Officer*

*Commissioner of Patents and Trademarks*